US009423751B2

(12) United States Patent
Shirakata et al.

(10) Patent No.: US 9,423,751 B2
(45) Date of Patent: Aug. 23, 2016

(54) IMAGE FORMING APPARATUS FOR CONTROLLING TONER DENSITY IN DEVELOPING UNIT

(71) Applicant: CANON KABUSHIKI KAISHA, Tokyo (JP)

(72) Inventors: Jiro Shirakata, Chigasaki (JP); Shusuke Miura, Toride (JP); Kana Oshima, Ako (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/990,132

(22) Filed: Jan. 7, 2016

(65) Prior Publication Data

US 2016/0202653 A1 Jul. 14, 2016

(30) Foreign Application Priority Data

Jan. 8, 2015 (JP) ..... 2015-002596

(51) Int. Cl.
*G03G 15/08* (2006.01)
*G03G 15/00* (2006.01)

(52) U.S. Cl.
CPC ..... *G03G 15/553* (2013.01); *G03G 15/0831* (2013.01); *G03G 15/0839* (2013.01)

(58) Field of Classification Search
CPC ..... G03G 15/0831; G03G 15/0839; G03G 15/553
USPC ..... 399/27, 254, 255, 258
See application file for complete search history.

(56) References Cited

U.S. PATENT DOCUMENTS 6,718,144 B2 * 4/2004 Hiroshima ..... G03G 21/1889 399/12
7,050,729 B2 * 5/2006 Fujiwara ..... G03G 15/0893 399/27

FOREIGN PATENT DOCUMENTS

JP 08-110696 A 4/1996

* cited by examiner

*Primary Examiner* — Hoang Ngo
(74) *Attorney, Agent, or Firm* — Fitzpatrick, Cella, Harper & Scinto

(57) ABSTRACT

A latent image forming unit forms an electrostatic latent image on a photosensitive member. A developing unit includes a container. The container stores toner. A circulating unit circulates the toner in the container. The developing unit develops the electrostatic latent image using the toner. A replenishment unit replenishes the developing unit with toner. A detection unit detects a density of the toner in the container. An acquisition unit acquires a circulation period at which the circulating unit causes the toner to circulate. A determining unit determines a correction condition based on the circulation period. A correction unit corrects a detection result of the detection unit based on the correction condition. A controller controls the replenishment unit based on the detection result corrected by the correction unit.

15 Claims, 14 Drawing Sheets

IMAGE FORMING APPARATUS FOR CONTROLLING TONER DENSITY IN DEVELOPING UNIT

BACKGROUND OF THE INVENTION

1. Field of the Invention

The present invention relates to an image forming apparatus, and in particular relates to replenishment control for maintaining a toner density in a developing unit at a target density.

2. Description of the Related Art

A developing unit using a two-component developer including a toner and a carrier detects toner density by a sensor to maintain toner density at a target density (Japanese Patent Laid-Open No. H08-110696). When toner is used for an image formation, the toner is replenished from a toner tank to the developing unit, and the toner and the carrier are mixed by a mixer.

In recent years, there is a demand for miniaturization, a reduction in capacity or the like in developing units. If a developing unit is miniaturized, the amount of replenished toner per time increases with respect to the capacity of the developing unit, and there are cases in which the toner and the carrier are not mixed sufficiently. In particular, toner density outputted by a sensor tends to fluctuate immediately after the toner is replenished. This is especially noticeable for a small-scale developing unit. An output value of the sensor repeatedly increases/decreases and finally converges to the actual toner density. Accordingly, if the toner is replenished using toner density acquired from the sensor when the toner and the carrier are not mixed sufficiently, the toner density cannot be controlled to the target density.

SUMMARY OF THE INVENTION

The present invention controls replenishment of toner to a developing unit at a higher precision.

The present invention provides an image forming apparatus comprising a photosensitive member, a latent image forming unit, a developing unit, a circulating unit, a drive unit, a replenishment unit, a detection unit, an aquisition unit, a determining unit, a correction unit, and a controller. The latent image forming unit forms an electrostatic latent image on the photosensitive member. The developing unit includes a container that stores a toner. The circulating unit conveys the toner in a predetermined direction in order to cause the toner to circulate in the container. The developing unit develops the electrostatic latent image using the toner in the container. The drive unit drives the circulating unit. The replenishment unit replenishes the developing unit with toner. The detection unit detects a density of the toner in the container. The acquisition unit acquires information related to a circulation period at which the circulating unit causes the toner to circulate. The determining unit determines a correction condition based on the information acquired by the acquisition unit. The correction unit corrects a detection result of the detection unit based on the correction condition determined by the determining unit. The controller controls the replenishment unit based on the detection result corrected by the correction unit.

Further features of the present invention will become apparent from the following description of exemplary embodiments (with reference to the attached drawings).

DESCRIPTION OF THE EMBODIMENTS

<Image Forming Apparatus>

The present embodiment can be applied to an image forming apparatus for forming an image by an electrophotographic method, an electrostatic recording method, or the like, on an image carrier using for example a photosensitive member, a dielectric or the like. The image forming apparatus forms a latent image corresponding to an image signal on an image carrier, and forms a visible image (toner image) by developing the latent image by a developing apparatus using a two-component developer. Toner particles and carrier particles are principal components of the two-component developer. A visible image is transferred onto a transfer material such as a paper by the image forming apparatus, and is fixed on the transfer material by a fixing apparatus. Also, the image forming apparatus may be any product such as a printer, a copying machine, a multi function peripheral, or a facsimile machine.

Figure 1:
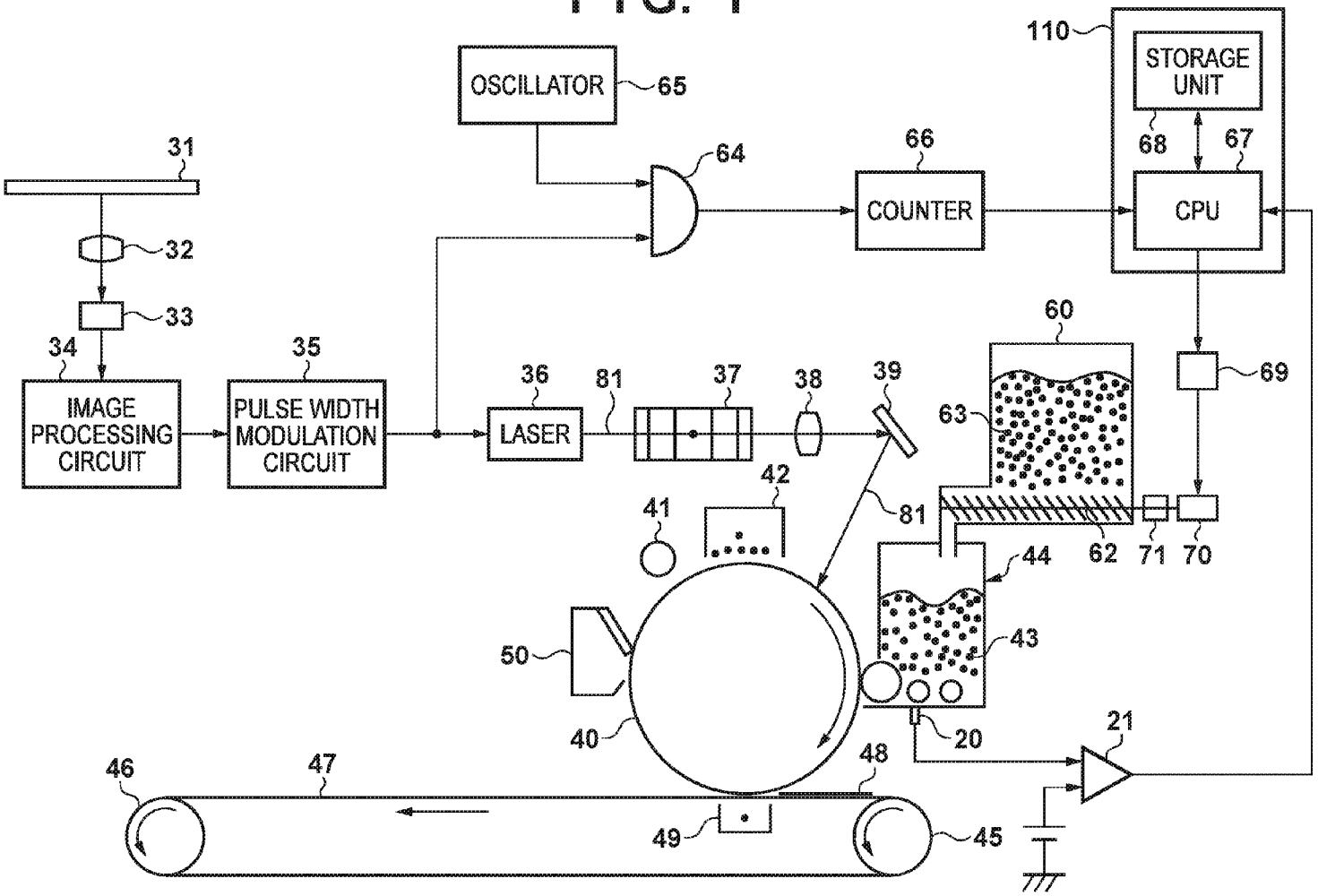
FIG. 1 is a view for illustrating an example of an image forming apparatus.

In FIG. 1, an image of an original 31 to be copied is projected to an image sensor 33 such as CCD (Charge Coupled Device) by a lens 32. The image sensor 33 divides the image of the original 31 into a large number of pixels, and generates a photoelectric conversion signal corresponding to a density (luminance) of each pixel. An analog image signal outputted from the image sensor 33 is transmitted to an image processing circuit 34. The image processing circuit 34 converts the analog image signal to a pixel image signal having an output level for each pixel that corresponds to the density of the pixel, and transmits that to a pulse width modulation circuit 35. The pulse width modulation circuit 35 forms and outputs a laser driving pulse for each inputted pixel image signal with a width (duration) corresponding to this level. A driving pulse with a wider width is generated for a high density pixel image signal, and a driving pulse with a narrower width is generated for a low density pixel image signal. A laser driving pulse outputted from the pulse width modulation circuit 35 is supplied to a semiconductor laser 36 which is a latent image forming unit. The semiconductor laser 36 emits only at a time corresponding to the pulse width. Accordingly, the semiconductor laser 36 is driven for a longer time for a high density pixel, and driven for a shorter time for a low density pixel.

A rotational polygonal mirror 37 deflects and scans a laser beam 81 emitted from the semiconductor laser 36. The laser beam 81 is caused to form a spot on a photosensitive drum 40 by a lens 38 such as an f/G lens and a fixed mirror 39. Then, the laser beam 81 scans on the photosensitive drum 40 in a direction (main scanning direction) substantially parallel to a rotation axis of the photosensitive drum 40, and thereby forms an electrostatic latent image. Note, there are devices that use a light source other than the semiconductor laser 36 in the present embodiment such as an LED (Light Emitting Diode) array as a latent image forming unit, and the present invention may also be suitably applied to these.

The photosensitive drum 40 is an example of the image carrier or the photosensitive member. The photosensitive drum 40 comprises a photosensitive layer of, for example, amorphous silicon, selenium, or an OPC (Organic Photoconductor) on its surface, and rotates in an arrow symbol direction. The photosensitive drum 40 charges uniformly by a primary charger 42 after an electric-charge remover 41 destaticizes uniformly. After that, exposure scanning is executed by the laser beam 81 modulated in accordance with the image signal. Thereby, an electrostatic latent image corresponding to the image signal is formed. A developing unit 44, which is a developing mechanism, performs inverse developing of an electrostatic latent image using a two-component developer (developing material 43) in which the toner particles and the carrier particles are mixed, and forms a visible image (toner image). Inverse developing is a development method for causing a toner that is charged to the same polarity as the latent image to be attached at a region where the surface of the photosensitive drum 40 is exposed by the laser beam 81, and visualizing that. A transfer charger 49 transfers the toner image to a transfer material 48 held on a carry belt 47. The endless carry belt 47 is stretched between a roller 45 and a roller 46 and driven in an arrow symbol direction.

Note, only one image forming station (including the photosensitive drum 40, the electric-charge remover 41, the primary charger 42, the developing unit 44, and the like) is shown graphically in order to simplify the explanation. For a color image forming apparatus, for example, four image forming stations corresponding to each color of cyan, magenta, yellow and black are arranged sequentially on the carry belt 47 in its movement direction. Electrostatic latent images for each color, for which a color decomposition of an image of an original is performed, are formed sequentially on the photosensitive drums of each image forming station, are developed by the developing units comprising a toner of each corresponding color, and are sequentially transferred to the transfer material 48 held and conveyed by the carry belt 47. The transfer material 48 to which the toner image is transferred is separated from the carry belt 47 and conveyed to a fixing unit (not shown), and the toner image is fixed thereon. Also, residual toner remaining on the photosensitive drum 40 after the transfer is removed by a cleaner 50.

Furthermore, in addition to an oscillator 65 for generating a clock pulse for estimating a toner amount used for the image forming, an AND gate 64 and a counter 66 are illustrated in FIG. 1. Also, a density sensor 20 for detecting toner density in the developing unit 44, an amplifier 21, or the like, are also illustrated. A replenishment controller 110 comprises a CPU 67 and a storage unit 68 and controls a toner replenishment amount.

Figure 2:
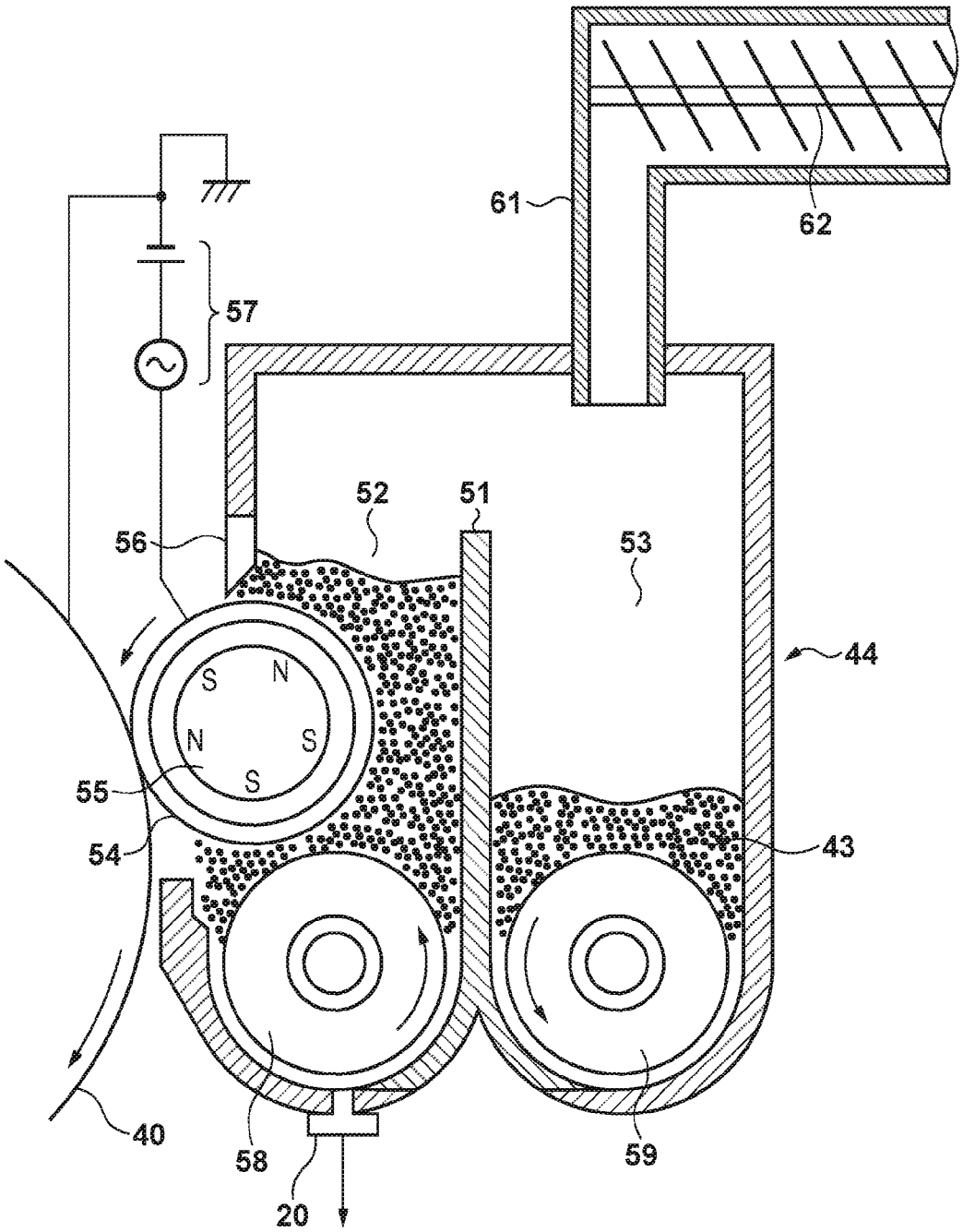
FIG. 2 is an overview cross-sectional view for illustrating an example of a developing unit.

An example of the developing unit 44 is explained with reference to FIG. 1 and FIG. 2. The developing unit 44 is arranged to face the photosensitive drum 40, and the interior is separated into a first chamber (developing chamber) 52 and a second chamber (mixing chamber) 53 by a partition 51 extending in a vertical direction. The first chamber 52 and the second chamber 53 are examples of containers for storing toner. A non-magnetic developing sleeve 54 rotating in the arrow symbol direction is arranged in the first chamber 52. The developing sleeve 54 functions as a conveying unit for conveying the developer to the image carrier. A magnet 55 is fixed in the developing sleeve 54. The developing sleeve 54 carries and conveys two-component developer, supplies the developer to the photosensitive drum 40 in a developing region facing the photosensitive drum 40, and thereby develops the electrostatic latent image. A thickness of a toner layer on the developing sleeve 54 is regulated by a blade 56. In order to improve a developing efficiency, i.e. a rate at which toner is added to the latent image, a developing voltage in which a direct current voltage from a power supply 57 is superimposed on an alternating voltage is applied to the developing sleeve 54.

In the first chamber 52, a screw 58 is arranged. The screw 58 functions as a first circulating unit for, in addition to mixing the two-component developer existing in the first chamber 52, causing the two-component developer to circulate between the first chamber 52 and the second chamber 53. In the second chamber 53, a screw 59 is arranged. The screw 59 functions as a second circulating unit for, in addition to mixing developing material 43 that was present in the second chamber 53 and toner 63 supplied by a toner replenishment basin 60, causes developing material 43 to circulate between the first chamber 52 and the second chamber 53. Also, the screws 58 and 59 function as mixing units for mixing a two-component developer within the developing unit 44. A conveying screw 62 conveys toner of the toner replenishment basin 60 while rotating, and supplies toner from a toner discharging port 61 to the second chamber 53. By the screw 59 mixing the toner 63 supplied from the toner replenishment basin 60 with the developing material 43 already present in the developing unit 44, the density of toner particles in the developing material 43 (toner density) becomes uniform. In the partition 51, paths (not shown) by which the first chamber 52 and the second chamber 53 communicate with each other are formed at a front side end portion and a far side end portion in FIG. 2. For the developing material 43 in the first chamber 52, by developing, the toner is consumed, and the toner density decreases. The developing material 43 in the first chamber 52 moves from a path on one side to within the second chamber 53 by the screw 58. The developing material 43, for which the toner density is recovered in the second chamber 53, moves into the first chamber 52 from the path on the other side by the screw 59.

On a bottom wall of the first chamber (the developing chamber) 52 of the developing unit 44, the density sensor 20 is installed. The density sensor 20 is a detection unit for detecting a toner density of the developing material 43 present in an internal region of the first developing chamber 52 of the developing unit 44. Note that the toner density indicates a ratio of toner within the developing material 43 stored in the developing unit 44 (a ratio by weight). The density sensor 20 is an inductance sensor, or the like, for detecting a permeability of the developing material 43. The density sensor 20 outputs a detected value corresponding to the toner density to the replenishment controller 110. The replenishment controller 110 functions as a control unit for controlling an amount of toner to replenish the developing unit 44 with so that the toner density detected by the density sensor 20 approaches a target density. Note that the density sensor 20 is an example of an output unit for outputting an output value that changes in accordance with the toner density of a region in a container.

The counter 66 is a consumed toner calculation unit according to a video counting method, and counts the level of the output signal of the image processing circuit 34 for every pixel. An output signal of the pulse width modulation circuit 35 is supplied to one input of the AND gate 64, and a clock pulse from the oscillator 65 is supplied to the other input of the AND gate 64. Accordingly, the AND gate 64 outputs clock pulses of a number corresponding to the pulse widths of the laser driving pulse, i.e. clock pulses of a number corresponding to the density for each pixel. The counter 66 obtains a video count value by integrating a clock pulse number for each image (an original) (a maximum video count value for an A4 original is 3707×106). A pulse integration signal (the video count value) for each image from the counter 66 corresponds to a toner amount consumed in the developing unit 44 in order to form 1 toner image of the original 31. There are various counters or the like for counting directly from image data for synchronizing the laser driving pulse other than a video counter such as the counter 66, and any counter can be applied to the present invention.

The replenishment controller 110 determines the replenishment amount for the toner 63 based on the video count value and the output of the density sensor 20, and controls a motor 70 which is a replenishment unit through a replenishment driver 69. A driving time and a number of operations for driving of the motor 70 are proportional to the replenishment amount essentially. A driving force of the motor 70 is transmitted to the conveying screw 62 via a gear array 71. The conveying screw 62 replenishes the developing unit 44 by conveying the toner 63 within the toner replenishment basin 60.

<Replenishment Control>

Figure 3:
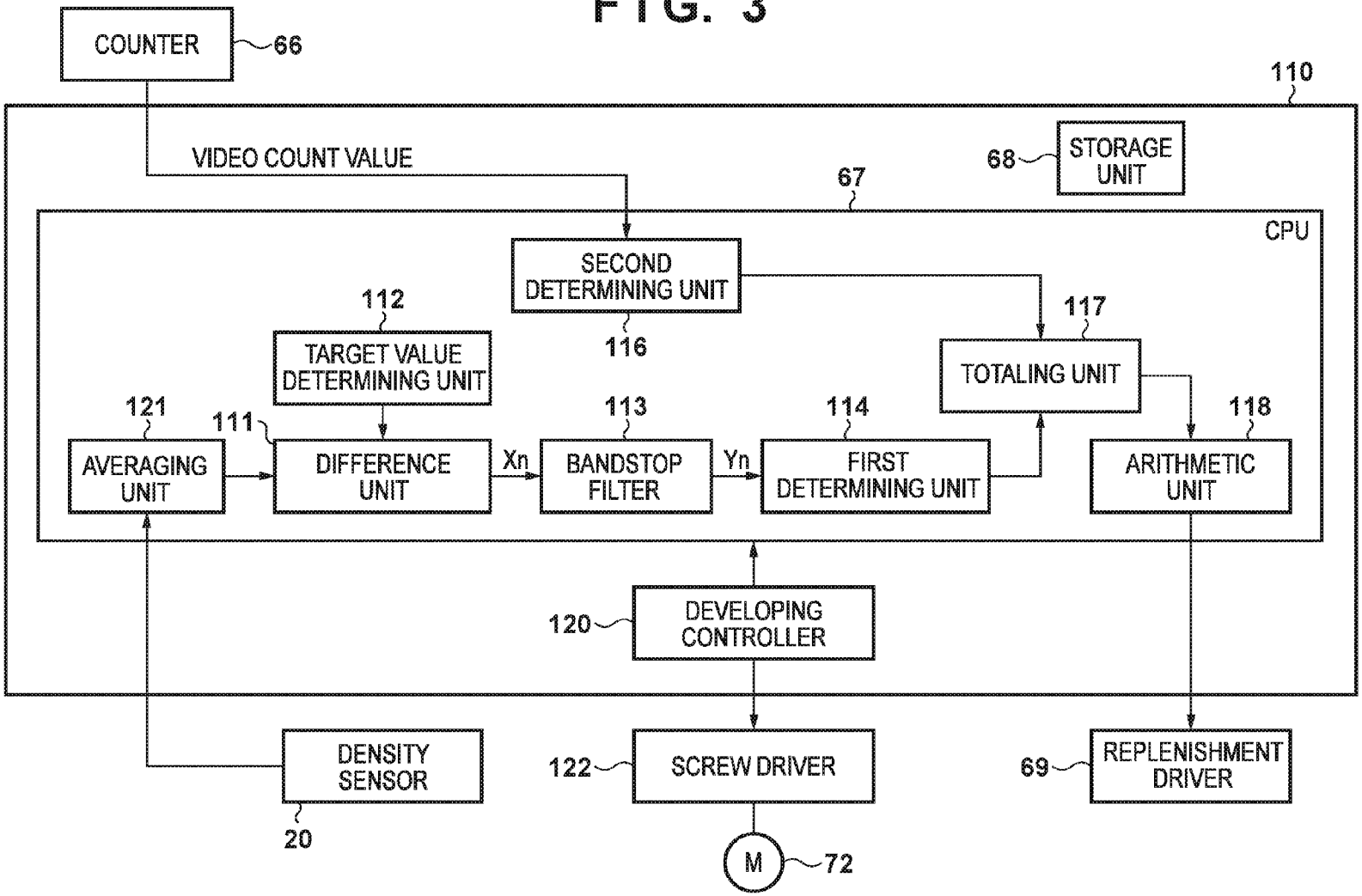
FIG. 3 is a block diagram for illustrating an example of a replenishment controller.

FIG. 3 is a block diagram for the replenishment controller 110 of the embodiment. The replenishment controller 110 in particular comprises a bandstop filter 113 and a first determining unit 114. The bandstop filter 113 is an example of filter unit for reducing a long period ripple that occurs in accordance with a developer circulation period in accordance with the screws 58 and 59 in the toner density detected by the density sensor 20. The first determining unit 114 is an example of a first determining unit for determining a first replenishment amount among replenishment amounts based on the toner density for which the long period ripple is reduced by the bandstop filter 113. For other functions illustrated by FIG. 3, explanation is given with reference to FIG. 4. A ripple period generated in accordance with a developer circulation period is, for example, 30 seconds, 60 seconds or the like. Meanwhile, a short period ripple occurs in the toner density in accordance with a rotation period (a mixing period) of the screws 58 and 59. This ripple period is, for example, around 0.1 seconds, 0.2 seconds or the like. The short period ripple is reduced by an averaging unit 121.

Figure 4:
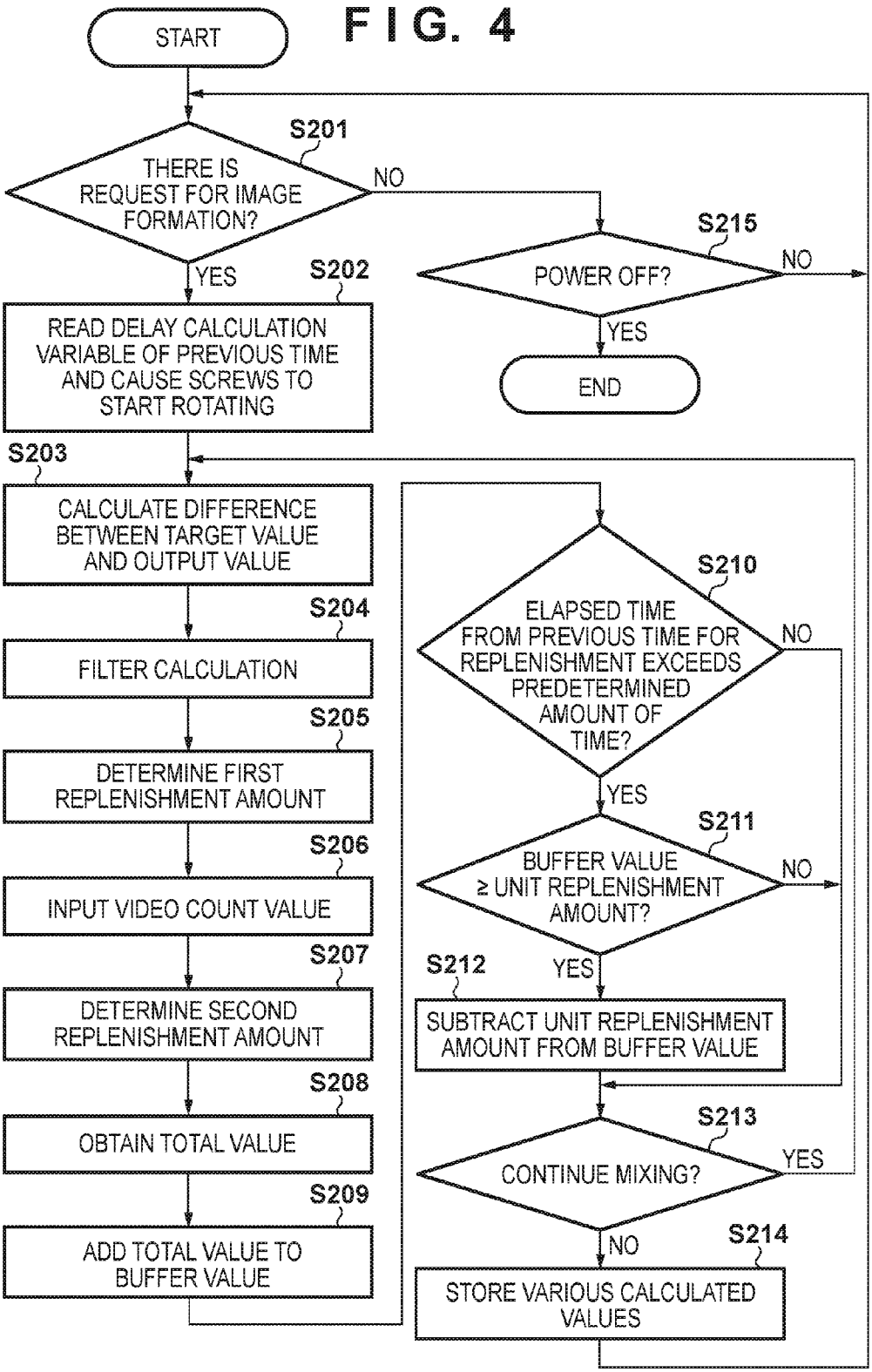
FIG. 4 is a flowchart for illustrating an example of a replenishment control.

FIG. 4 is a flowchart for illustrating an operation of the CPU 67. The various functions illustrated in FIG. 3 are realized by the CPU 67 reading a control program from a ROM of the storage unit 68 and executing it when power is supplied from the external power supply to the image forming apparatus and it activates. Note that these functions may be performed by hardware by logic circuits.

In step S201, the CPU 67 enters a standby state, and determines whether or not an image formation request is received from the operation unit or an external computer. If there is no request for image formation, the CPU 67 proceeds to step S215. In step S215, the CPU 67 determines whether or not a power OFF was instructed from the operation unit. If a power OFF is not instructed, the CPU 67 returns to step S201. If a power OFF is instructed, the CPU 67 executes a shutdown of the image forming apparatus. If there is a request for image formation in step S201, the CPU 67 proceeds to step S202.

In step S202, the CPU 67 reads a delay calculation variable of the previous time which is stored in a RAM of the storage unit 68, and instructs a developing controller 120 for rotation of the screws 58 and 59. The developing controller 120 drives a motor 72 for a screw driver 122. The motor 72 causes the screws 58 and 59 to rotate. The motor 72 is an example of a drive unit for driving a circulating unit. The drive unit drives the circulating unit so that the circulation period changes in accordance with the rotating speed of the photosensitive member.

In step S203, the CPU 67 (a difference unit 111) calculates to obtain a difference between an output value of the averaging unit 121 and a target value set by a target value determining unit 112. The averaging unit 121 has a function for smoothing the output of the density sensor 20. The averaging unit 121 functions as a calculation unit that averages detection values of the density sensor 20 to reduce short period ripple generated in toner density in accordance with the mixing period.

In step S204, the CPU 67 (the bandstop filter 113) obtains Yn by executing a filter calculation using the following equation with respect to a difference Xn outputted from the difference unit 111.

$$Yn=b0\times Xn+Pn-1 \quad (1)$$

$$Pn=b1\times Xn-a1\times Yn+Qn-1 \quad (2)$$

$$Qn=b2\times Xn-a2\times Yn \quad (3)$$

Here, Xn is the current output value of the difference unit 111. Yn is this time's output value of the bandstop filter 113. Pn and Qn are delay calculation variables for this time. Pn−1 and Qn−1 are delay calculation variables of the previous time, are read out from the storage unit 68. The CPU 67 stores the delay calculation variables Pn and Qn obtained by the calculation this time in the storage unit 68, and uses them in the calculation of the next time. The coefficients a1, a2, b0, b1, and b2 are filter coefficients determined in advance at the time of designing the image forming apparatus, at the time of shipment from the factory, or the like. In the present embodiment, Yn is calculated every 0.1 seconds.

Figure 5A:
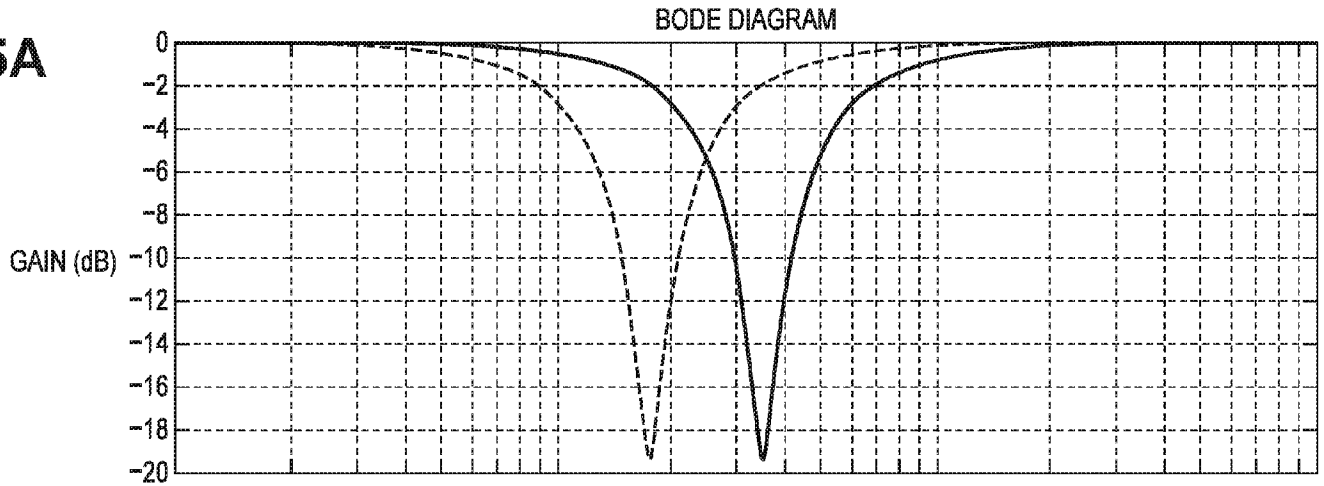
FIGS. 5A and 5B are views for illustrating an example of characteristics of a bandstop filter.
Figure 5B:
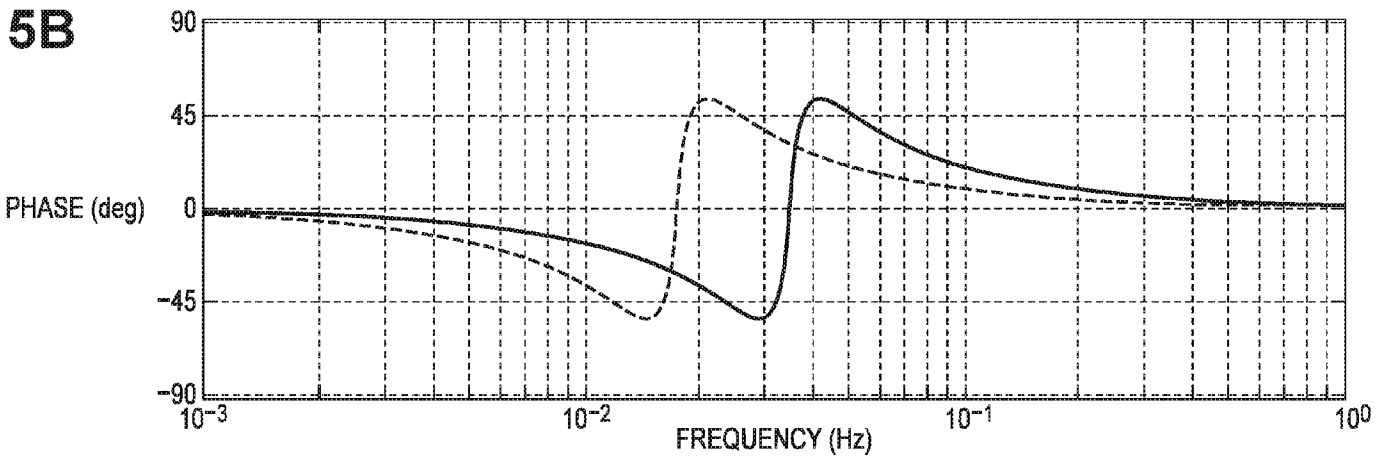

FIG. 5A is a Bode diagram for illustrating a relationship between frequency and gain for the bandstop filter 113. FIG. 5B is a Bode diagram for illustrating a relationship between frequency and phase for the bandstop filter 113. The solid line illustrates a characteristic of the bandstop filter 113 set such that a 30 second period ripple is reduced. The broken line illustrates a characteristic of the bandstop filter 113 set such that a 60 second period ripple is reduced. In particular, filter coefficients for configuring the bandstop filter 113 of the characteristics illustrated by the solid line are as follows.

$$a1=-1.97723 \quad (4)$$

$$a2=0.977668 \quad (5)$$

$$b0=0.990025 \quad (6)$$

$$b1=-1.97723 \quad (7)$$

$$b2=0.987643 \quad (8)$$

In this way, these filter coefficients are determined in advance in accordance with the ripple period to be reduced. Note that it is possible to change the characteristics of the bandstop filter 113 even by changing the interval (the calculation execution time interval) for executing the calculation of Yn without modifying the filter coefficients.

In step S205, the CPU 67 (the first determining unit 114) determines a first replenishment amount based on the output value Yn of the bandstop filter 113. The first determining unit 114 is a PI controller (proportional integration controller), which adds the current output value Yn and the accumulated value Tn of the output values up until the previous time to determine a first replenishment amount R1n.

$$R1n=g1\times Yn+g2\times Tn \tag{9}$$

$$Tn=Tn-1+Yn \tag{10}$$

g1 and g2 are gains, and are coefficients that are set in advance.

In step S206, the CPU 67 (a second determining unit 116) inputs the video count value from the counter 66. Note that the second determining unit 116 is an example of a prediction unit for predicting a toner amount that was consumed from the developing unit based on the inputted image data. Note that the replenishment driver controls the replenishment unit based on the result of the prediction (the toner amount) by the measurement unit, and the result of the detection that is calculated and corrected by a correction unit. In step S207, the CPU 67 (the second determining unit 116) determines a second replenishment amount R2n by applying a calculation explained later to a video count value. In step S208, the CPU 67 (a totaling unit 117) totals the first replenishment amount R1n and the second replenishment amount R2n to obtain a total value Rn (Rn=R1n+R2n). In step S209, the CPU 67 (an arithmetic unit 118) adds the total value Rn to a buffer value Bn of a replenishment amount (Bn=Bn−1+Rn). Note that the initial value of the buffer value Bn is, for example, zero.

In step S210, the CPU 67 determines whether or not the elapsed time from when the replenishment driver 69 was instructed for replenishment the previous time exceeds a predetermined amount of time. The CPU 67 counts the elapsed time from when replenishment is instructed using a timer, a counter or the like. The CPU 67 resets the timer to zero when replenishment is instructed. When replenishment is instructed, the replenishment driver 69 drives the motor 70, causing the screws 58 and 59 to rotate, and replenish the developing unit 44 with the toner 63. If the elapsed time does not exceed the predetermined amount of time, the CPU 67 proceeds to step S211. In this way, the replenishment driver 69 prohibits the replenishment unit from replenishing the developing unit with toner if a predetermined amount of time has not elapsed since the previous time that replenishment was executed by the replenishment unit. If the elapsed time does exceed the predetermined amount of time, the CPU 67 proceeds to step S213. The predetermined amount of time is a time for allowing the toner density to become uniform in the developing unit 44, and is determined in advance by experimentation, simulation, or the like. If the next replenishment is executed in a state in which mixing of the developing material 43 and the toner 63 in the developing unit 44 is insufficient, it will result in a localized dense portion in the toner density in the developing unit 44. Accordingly, by continuing mixing across a predetermined amount of time from the start of replenishment, and permitting replenishment thereafter, uniformization of the toner density is achieved.

In step S211, the CPU 67 (the arithmetic unit 118) determines whether or not the buffer value Bn reaches a predetermined unit replenishment amount r or greater. If the buffer value Bn is the unit replenishment amount r or greater, the CPU 67 proceeds to step S212. If the buffer value Bn is not the unit replenishment amount r or greater, the CPU 67 proceeds to step S213.

In step S212, the CPU 67 (the arithmetic unit 118) in addition to instructing the replenishment driver 69 for replenishment, subtracts the unit replenishment amount r from the buffer value Bn. The replenishment driver 69, in accordance with the instruction, drives the motor 70 to replenish the developing unit with the toner 63.

In step S213, the CPU 67 determines whether or not to continue mixing by the screws 58 and 59. For example, the CPU 67 determines that mixing should be continued if image formation by an image formation request detected in step S201 continues. Also, the CPU 67 determines that mixing should be stopped if image formation terminates. If mixing continues, the CPU 67 returns to step S203, and the CPU 67 calculates the next difference. If mixing should be stopped, the CPU 67 proceeds to step S214. In step S214, the CPU 67 causes various calculated values (example: the delay calculation variables Pn and Qn, the buffer value Bn, or the like) to be stored in the storage unit 68. Note that the buffer value Bn, the first replenishment amount R1n, the second replenishment amount R2n or the like are reset to zero. After that, the processing returns to step S201. In this way, the sequence of processing from step S203 to step S213 is something that is performed every 0.1 seconds, for example. For that reason, the unit replenishment amount r corresponds to a toner amount replenished every 0.1 seconds.

<Second Replenishment Amount Determination Method>

In the present embodiment, the processing for determining the replenishment amount for which the output value of the density sensor 20 is fed back is executed in intervals of 0.1 seconds during operation of the screws 58 and 59. However, the video count value is an integrated value for 1 image. If the integrated value is converted into a replenishment amount unchanged, the replenishment amount for every 0.1 seconds will be excessive. This is because the first replenishment amount R1n is determined based on an output value of the density sensor 20 which is output every 0.1 seconds. Accordingly, the second replenishment amount R2n determined based on the video count value is made to be a replenishment amount distributed every 0.1 seconds. Accordingly, the second determining unit 116 outputs a replenishment amount based on the video count value divided over a predetermined number of times.

Figure 6:
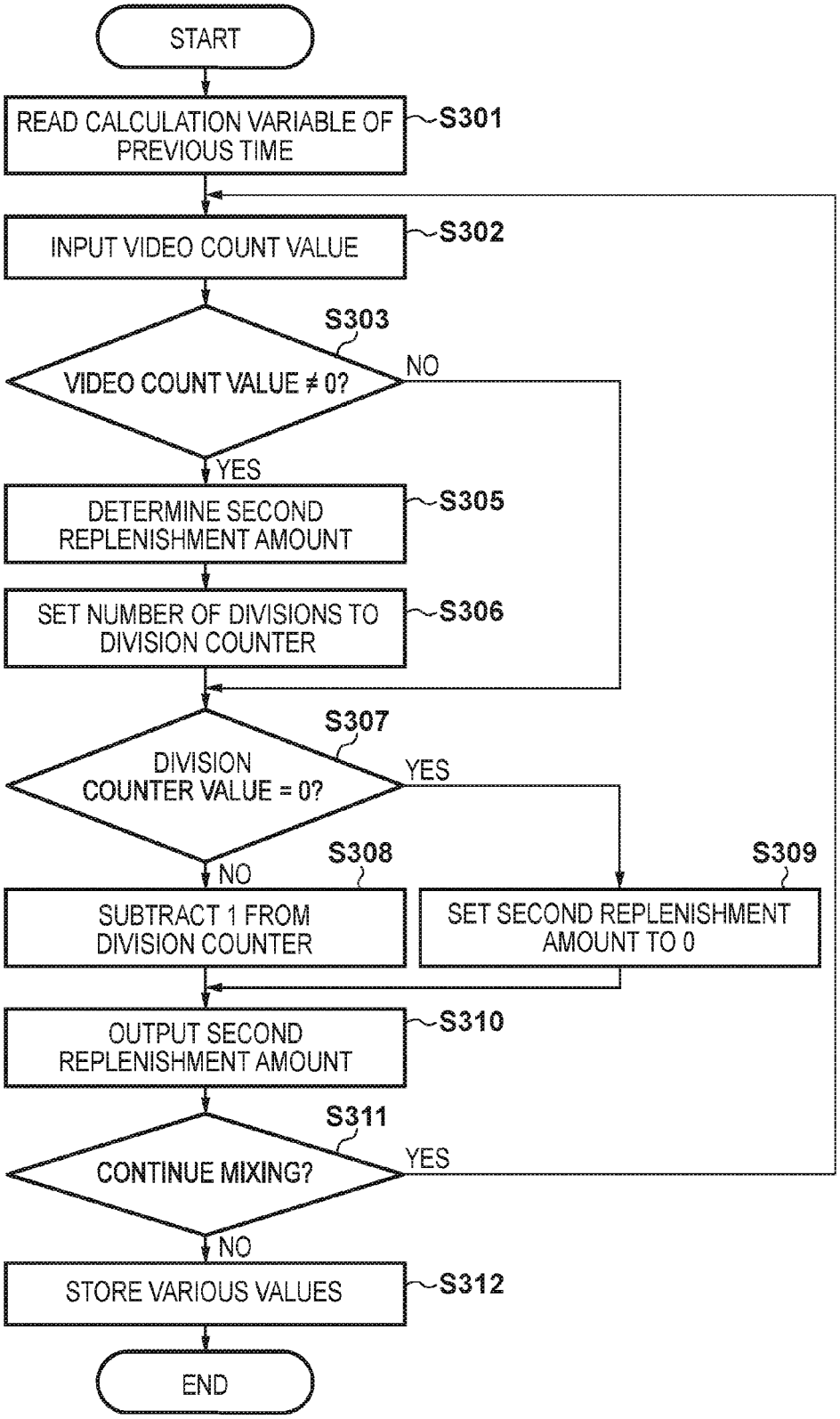
FIG. 6 is a flowchart for illustrating an example of an approach to determining a replenishment amount based on a toner consumption amount.

FIG. 6 is a flowchart for illustrating an operation of the CPU 67 (the second determining unit 116). The second determining unit 116 starts a calculation for determining the replenishment amount at the same time as starting rotation of the screws 58 and 59.

In step S301, the second determining unit 116 reads out a calculated value of the previous time from the storage unit 68. In step S302, the second determining unit 116 inputs the video count value (the integrated value) from the counter 66. Step S302 is performed every 0.1 seconds across a period in which the screws 58 and 59 are rotating, but until an integration of the video count value for 1 image ends, 0 is input as the video count value. At the point in time when the integration ends, the integrated value is inputted one time.

In step S303, it is determined whether or not the video count value that the second determining unit 116 inputted is 0. If the video count value is 0, the second determining unit 116 proceeds to step S307 without modifying the current second replenishment amount. If the video count value is not 0, the second determining unit 116 proceeds to step S305.

In step S305, the second determining unit 116 determines a second replenishment amount U2k. The second replenishment amount U2k is determined by the following formula, for example.

$$U2k=g2\times(U2k-1\times C+V)\div D \quad (11)$$

Here, U2k is the second replenishment amount determined this time. Here, U2k−1 is the second replenishment amount determined the previous time. V is the inputted video count value (the integrated value). D is the number of divisions. C is a current value of the division counter. The division counter C is an integer greater than or equal to 0, and an initial value is the number of divisions D. Until the division counter C becomes 0, it is decremented by 1 every 0.1 seconds in step S308.

Note that the second replenishment amount U2k is updated every execution of step S305. In other words, the second replenishment amount U2k is used as R2n without being updated until step S305 is executed or the count value C becomes zero. Incidentally, before the first video count value is input, and replenishment of toner of a replenishment amount corresponding thereto finishes, the next video count value is input. In other words, it is necessary to carry over the remaining amount in the total replenishment amount for the first video count value to the replenishment amount for the next video count value. U2k−1×C has the meaning of this carried over replenishment amount. For example, when the next video count value is input immediately for the first video count value, C is still a large value, and a large portion of the replenishment amount corresponding to the first video count value is carried over. If C is zero, the replenishment amount corresponding to the first video count value is not carried over.

In this way, if the division counter C is not 0, the output of the division replenishment amount for the video count value of the previous time is not terminated. For this reason, as is illustrated in formula (11), the second determining unit 116 obtains the second replenishment amount U2k by totaling the remaining replenishment amount (U2k−1×C) and the video count value V input newly. If the division counter C is 0, the second determining unit 116 determines the second replenishment amount U2k from the video count value V of this time. The second replenishment amount determined here is subsequently used as the second replenishment amount R2n (R2n=U2k).

In step S306, the second determining unit 116 sets the number of divisions D to the division counter C.

$$C=D \quad (12)$$

In step S307, the second determining unit 116 determines whether or not the division counter C is 0. Because the division replenishment based on the video count value V is not completed if the division counter C is not 0, the second determining unit 116 proceeds to step S308. In step S308, the second determining unit 116 subtracts 1 from the division counter C. Meanwhile, because if the division counter C is 0, the division replenishment is completed, the second determining unit 116 proceeds to step S309. In step S309, the second determining unit 116 sets the second replenishment amount R2n to 0.

In step S310, the second determining unit 116 outputs the second replenishment amount R2n to the totaling unit 117. In step S311, the second determining unit 116 determines whether or not mixing should be continued. The method of the determination of step S311 is similar to that of step S213. If mixing should be continued, the second determining unit 116 returns to step S302. If mixing should be stopped, the second determining unit 116 proceeds to step S312. In step S312, the second determining unit 116 causes the division counter C and the second replenishment amount R2n to be stored in the storage unit 68.

<Processing Accompanying Introduction of Bandstop Filter>

While the screw 58 is rotating, a ripple of a particular frequency occurs in the detected values of the density sensor 20. A long period ripple frequency is the reciprocal of the toner circulation period. The bandstop filter 113 is arranged in order to reduce this long period ripple in the detected value of the density sensor 20. Furthermore, a short period ripple occurs in accordance with the mixing period (rotation period) of the screw 58. While the ripple period accompanying toner circulation is around 30 seconds, the ripple period accompanying the rotation period is around 0.1 seconds. The numerical values of these periods are merely examples. Accordingly, a unit for reducing a short period ripple is necessary. Note that while the screw 58 is rotating, detected values of the density sensor 20 are acquired at predetermined intervals.

Figure 7A:
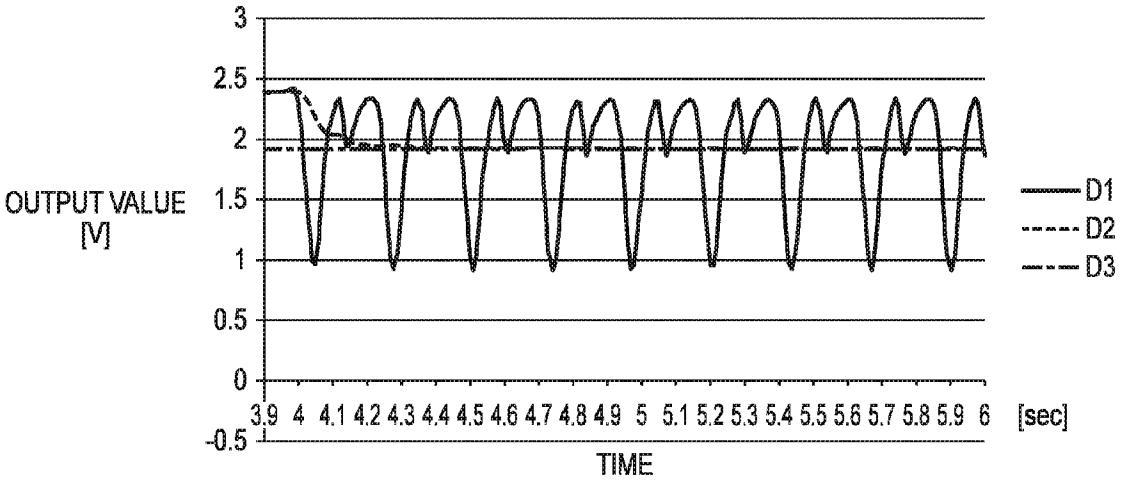
FIGS. 7A and 7B are views for explaining an effect of an averaging unit.
Figure 7B:
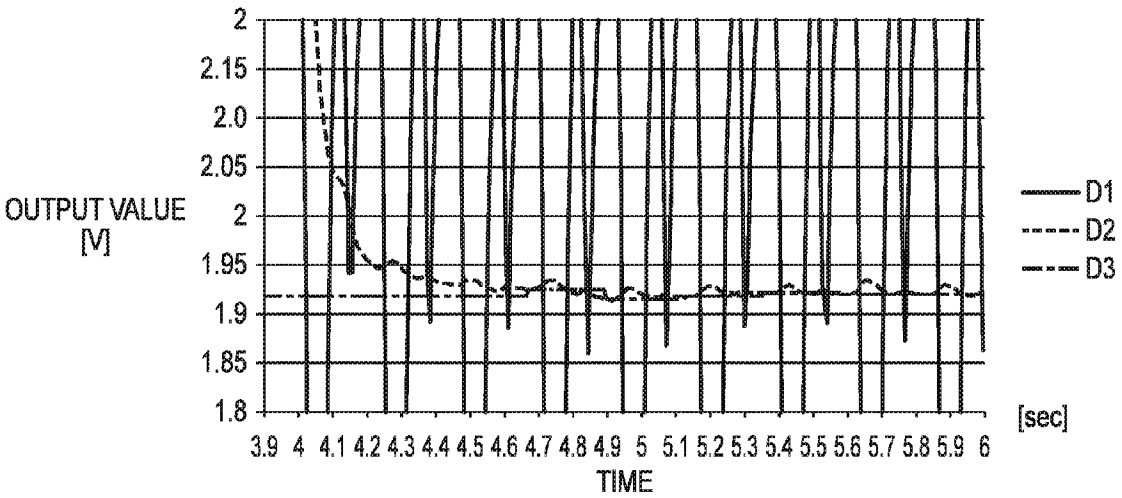

FIG. 7A exemplifies detected values D1 o the density sensor 20, a moving average D2 of the detected values, and average values D3 accompanying an initial mask. FIG. 7B is a view for magnifying a portion of an interval in which the initial mask is applied in FIG. 7A. In FIG. 7A and FIG. 7B, a solid line illustrates the detected values D1 of the density sensor 20. The broken line illustrates the moving average D2 of the detected values. The dashed-dotted line illustrates the average values D3 accompanying the initial mask.

As is illustrated by the solid line of FIG. 7A and FIG. 7B, the detected values D1 of the density sensor 20 pulsate accompanying the rotation of the screw 58. This is because the toner density of the developing material 43 detected by the density sensor 20 varies in accordance with the rotation period of the screw 58. Accordingly, the averaging unit 121 averages the detected values D1 in accordance with the rotation period of the screw 58, and outputs the average values to the difference unit 111.

In a case where a replenishment amount is calculated for each page, if averaging is executed with a sufficient margin from when the screw 58 starts rotating, the short period ripple will become smaller. However, for the bandstop filter 113, detected values of the density sensor 20 in a predetermined interval when the screw 58 is rotating are necessary. In other words, average values are necessary immediately when the screw 58 starts rotating.

As the broken lines of FIG. 7A and FIG. 7B illustrate, when the moving average D2 is obtained for the detected values D1 of the density sensor 20 simply, the moving average D2 does not converge at the point where rotation of the screw 58 starts. Accordingly, the averaging unit 121 performs averaging processing by a flow illustrated in FIG. 8. In particular, the averaging unit 121 executes averaging by masking an unstable region generated across a predetermined period immediately after the rotation of the screw 58 starts. This brings about an effect that the memory capacity required for the calculation can be reduced. In this way, the averaging unit 121 is an example of a masking unit that masks the toner density output from the density sensor 20 across a predetermined period from when the screws 58 and 59 start operation so that it is not reflected in the first replenishment amount R1n.

Using FIG. 8, explanation will be given for an averaging calculation that the averaging unit 121 executes. The averaging unit 121 starts a calculation for averaging when the screws 58 and 59 start rotating.

In step S401, the averaging unit 121 reads from the storage unit 68 the last averaging output value (an average value) saved when the screws 58 and 59 stopped the previous time. In step S402, the averaging unit 121 sets the mask counter Cm and the accumulation counter Ca to 0. The mask counter Cm is a counter for managing the target of masking in the detected values D1 of the density sensor 20. The accumulation counter Ca is a counter for counting how many times the detected values D1 are accumulated. In step S403, the averaging unit 121 adds 1 to the accumulation counter Ca. In step S404, the averaging unit 121 determines whether or not the mask counter Cm reaches a predetermined value Cmx. The predetermined value Cmx indicates a total number of the masked average value. If the mask counter Cm is the predetermined value Cmx, the averaging unit 121 proceeds to step S406. If the mask counter Cm is not the predetermined value, the averaging unit 121 proceeds to step S405. In step S405, the averaging unit 121 adds 1 to the mask counter Cm.

In step S406, the averaging unit 121 adds (an accumulation calculation) the current detected value D1 of the density sensor 20 to the accumulated value Da of the detected value D1. In step S407, the averaging unit 121 determines whether or not the accumulation counter Ca reaches the predetermined value Cax. If the accumulation counter Ca does not reach the predetermined value Cax, the averaging unit 121 skips step S408 and step S409 and proceeds to step S410. The predetermined value Cax is the accumulated total number of the detected values D1, and is predetermined. If the accumulation counter Ca the predetermined value Cax reaches the predetermined value Cax, the averaging unit 121 proceeds to step S408.

In step S408, the averaging unit 121 sets the accumulation counter Ca to 0. In step S409, the averaging unit 121 determines whether or not the mask counter Cm reaches a predetermined value Cmx. The value of the predetermined value Cmx, as FIG. 7B illustrates, corresponds to the time from the time at which the screw 58 starts rotating to the time at which the moving average D2 finally converges with the average values D3. If the mask counter Cm does not reach the predetermined value Cmx, the initial change component remains in the detected value D1, and so it should be masked. Accordingly, the averaging unit 121 proceeds to step S410. Note that, if the mask counter Cm reaches the predetermined value Cmx, the initial change component does not remain in the detected values D1, and so masking is not necessary. Accordingly, the averaging unit 121 proceeds to step S411.

In step S410, the averaging unit 121 sets an average value D3' of the previous time stored in the storage unit 68 as the average value D3 output to the difference unit 111. In step S411, the averaging unit 121 obtains the average value D3 by dividing the accumulated value Da by the predetermined value Cax which is the accumulation number. In step S412, the averaging unit 121 outputs the average value D3 to the difference unit 111. In step S413, the averaging unit 121 determines whether or not mixing should be continued. This is determination processing similar to that of step S213 and step S311. If mixing should be continued, the averaging unit 121 returns to step S403. If mixing should be stopped, the averaging unit 121 proceeds to step S414. In step S414, the averaging unit 121 causes the last average value D3 to be stored in the storage unit 68.

In this way, in accordance with this embodiment, by using the bandstop filter 113, a long period ripple that occurs in the toner density depending on the toner circulation period can be reduced. Furthermore, by using the averaging unit 121, a short period ripple that occurs in the toner density depending on the mixing period of the screws 58 and 59 can be reduced. Furthermore, by masking the toner density acquired in a predetermined period from when rotation of the screws 58 and 59 starts among the detected values of the toner density, an influence of an initial rotation change component can be reduced. Note that, by using the average value D3' of detected values in the past in the predetermined period, it is possible to prepare data necessary for the bandstop filter 113.

Comparative Example 1

Explanation will be given comparative example 1 to explain the effect of the embodiment. Comparative example 1 is something that omits the bandstop filter 113 and the averaging unit 121 from the embodiment. Note that comparative example 1 is not prior art.

Figure 9:
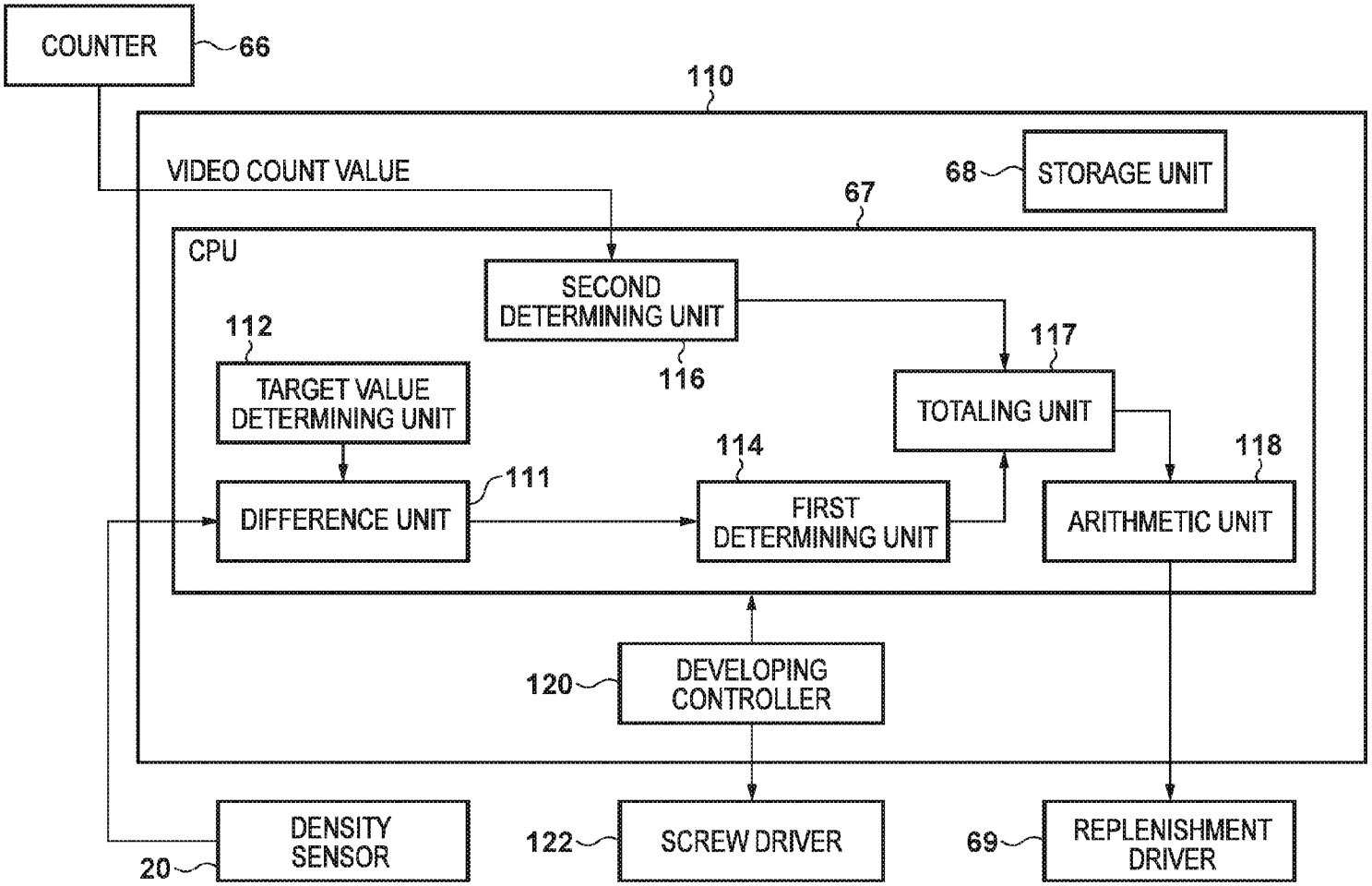
FIG. 9 is a block diagram for illustrating the replenishment controller of a comparative example 1.

FIG. 9 is a block diagram for the replenishment controller of comparative example 1. Because the averaging unit 121 is omitted, the difference unit 111 calculates the difference Xn between a detected value D1n from the density sensor 20 and a target value Dt determined by the target value determining unit 112. Also, because the bandstop filter 113 is omitted, the first determining unit 114 determines as the first replenishment amount R1n a sum of something for which a predetermined gain g1 is multiplied with the difference Xn of this time, and something for which a predetermined gain g2 is multiplied with the accumulated value Tn of the difference up until the previous time.

$$R1n=g1\times Xn+g2\times Tn \tag{13}$$

$$Tn=Tn-1+Xn \tag{14}$$

Note that the second replenishment amount R2n of comparative example 1 is the same as that of the embodiment. The flowchart of comparative example 1 is something that omits steps related to the bandstop filter 113 and the averaging unit 121 from the flowchart of the embodiment. Specifically, steps that are omitted are the variable read out of step S202 and the filter calculation of step S204, or the like.

Comparative Example 2

The comparative example 2, is something in which in step S207 of the first embodiment, processing for dividing the replenishment amount based on the video count value illustrated in FIG. 6 over a predetermined number of times and outputting is omitted. In other words, the replenishment amount converted from the video count value (the integrated value for 1 image) is reflected in the total value in one go. Note that comparative example 2 is not prior art. In the comparative example 2, processing other than the processing illustrated in FIG. 6 and that of step S207 of the embodiment is the same as in the embodiment. In other words, the block diagram of the comparative example 2 is the same as in FIG. 3. Also, the mask processing illustrated in FIG. 8 is used. For the second replenishment amount R2n, when V that is not zero is input, calculation is performed by the formula (15). When V is zero, the second replenishment amount R2n becomes zero.

$$R2n=g2\times V \tag{15}$$

<Explanation of Effect of Replenishment Control of Embodiment>

Figure 10A:
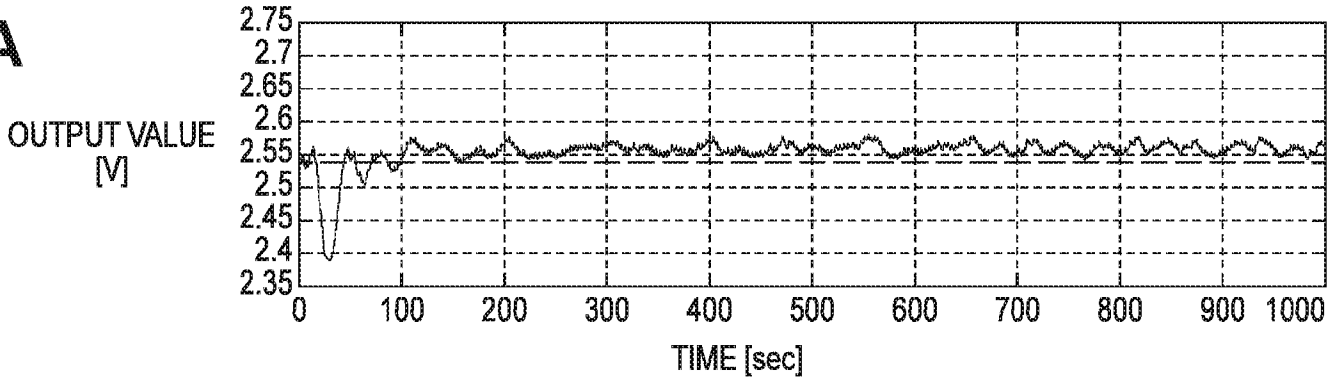
FIGS. 10A to 10D are views for explaining an effect of an embodiment.
Figure 10B:
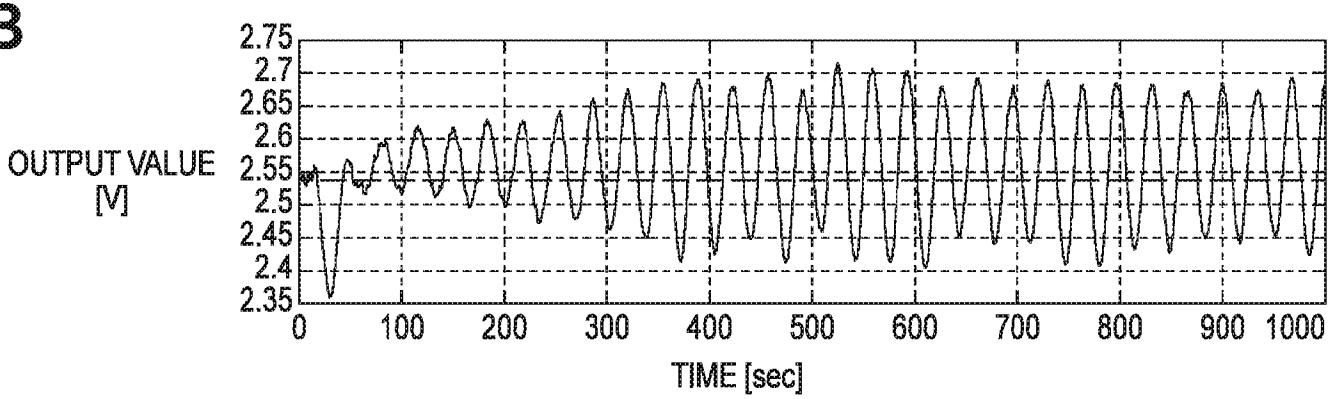
Figure 10C:
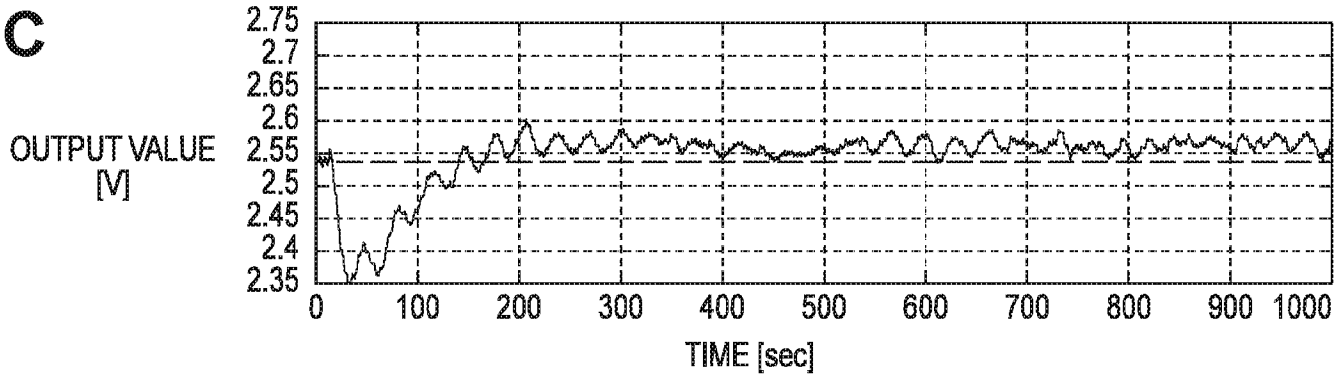

Explanation is given for an effect of the embodiment by comparing the embodiment with comparative example 1 and the comparative example 2. FIG. 10A illustrates output values of the density sensor 20 in the embodiment. FIG. 10B illustrates output values of the density sensor 20 in comparative example 1. Note that equivalent feedback gains are set for the output values of the embodiment and the output values of comparative example 1 respectively. FIG. 10C illustrates an output value for when the gain of comparative example 1 caused to be lower than in the embodiment.

It can be seen by comparing FIG. 10A and FIG. 10B that the embodiment can reduce a plurality of ripples for which the periods differ sufficiently by the averaging processing and the filter. In other words, in the embodiment, the output values converge quickly to the target value. In comparative example 1, because a feedback gain that is equivalent to that of the embodiment is set, large ripples occur in the output values. This is because the toner cannot be mixed sufficiently due to the miniaturization of the developing unit 44. In other words, in comparative example 1, developer for which the toner density is not uniform in the detection unit of the density sensor 20 pours in. Its influence is fed back for the toner replenishment amount, and control oscillation occurs. In order to prevent this oscillation, lowering of the feedback gain can be considered. However, when the feedback gain is lowered, the capability of the output value to return to the target value is degraded, as is illustrated in FIG. 10C. Accordingly, once the output values deviate from the target value due to an external disturbance, the state of deviation continues for a long time.

In contrast to this, in the embodiment, the change in the output values of the density sensor 20 depending of the toner circulation period can be reduced by the bandstop filter 113. Also, the change in the output values of the density sensor 20 in accordance with the mixing period can be reduced by the averaging unit 121. Accordingly, in the embodiment, the influence of change on the feedback control decreases, and good trackability with respect to the target value, and good convergence can be realized.

Also, in the embodiment, the calculation period of the bandstop filter 113 may be synchronized to the operation of the screws. This means that the calculation period of the bandstop filter 113 is not influenced by the size of the image.

Figure 10D:
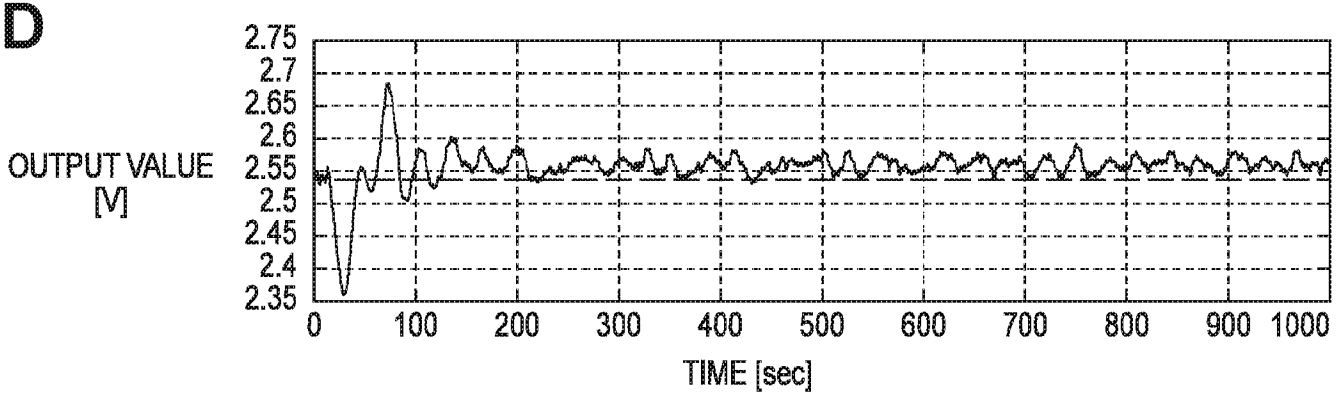
Figures 11A, 11B, 11C, 11D:
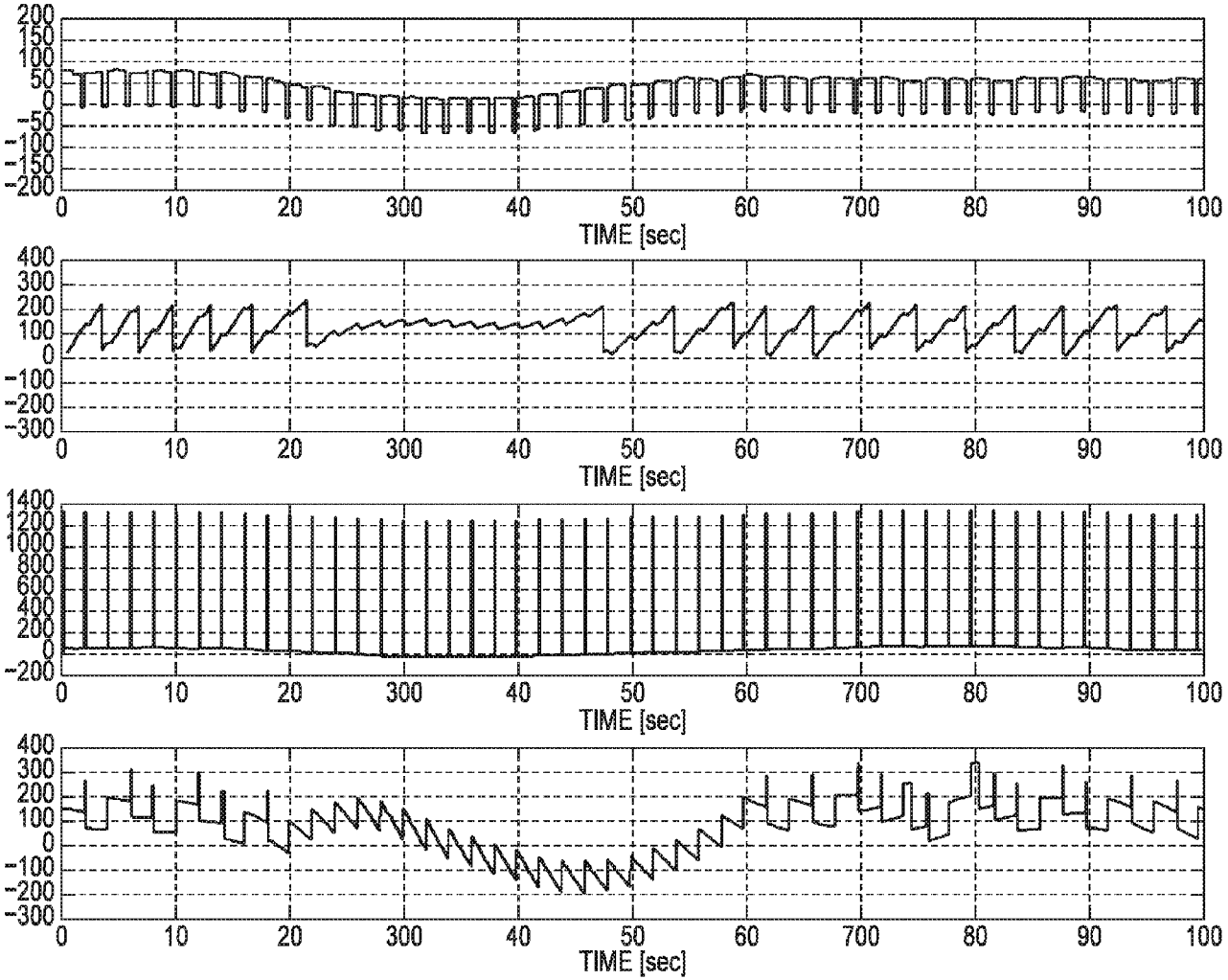
FIGS. 11A to 11D are views for explaining an effect of an embodiment.

FIG. 10D illustrates output values of the density sensor in comparative example 2. Comparing FIG. 10D and FIG. 10A, in FIG. 10D, in several places ripples of the waveform becomes large. FIG. 11A illustrates a total value that the totaling unit 117 of the embodiment outputs. FIG. 11B illustrates a replenishment buffer value in the arithmetic unit 118 of the embodiment. FIG. 11C illustrates a total value that the totaling unit 117 of the comparative example 2 outputs. FIG. 11D illustrates a replenishment buffer value in the arithmetic unit 118 of the comparative example 2.

In the comparative example 2, the calculation of the replenishment amount is executed in fine steps in synchronization with the operation of the screw as in the embodiment. For this reason, as FIG. 11C illustrates, there are cases where the video count value inputted discretely becomes a relatively large value. In other words, in the comparative example 2, there are cases of excessive replenishment amounts. This is the cause of the ripples illustrated in FIG. 10D.

In contrast to this, in the embodiment, the video count value is distributed with good balance and reflected in the replenishment amount as FIG. 11A illustrates. For this reason, in the embodiment, as FIG. 10A illustrates, the output values of the density sensor 20 transition well.

<Adjustment of Stopband in Accordance with Process Speed>

The image forming apparatus has multiple process speeds (also referred to as an image forming speed, a conveying speed or the like), and the process speed is switched in accordance with the characteristics (the thickness, material, or the like) of a recording medium such as the transfer material 48, or the like. For example, when forming an image on thick paper, the process speed is slower than the process speed for a normal paper. This is because in order to fix toner on a thick paper, it is necessary to apply more heat to the thick paper in the fixing unit. For this reason, by making the process speed slower, the time over which the thick paper passes through the fixing unit is made to be longer, and an amount of heat applied to the thick paper is increased.

As described above, the screws 58 and 59 are driven by the motor 72, but the rotating speed of the screws 58 and 59 is proportional to the process speed (the image forming speed). This is because the speed at which the toner is consumed is proportional to the process speed, and therefore it is necessary to make the speed at which the toner is caused to circulate also be proportional to the process speed.

In this way, when the type of the recording medium is designated, the CPU 67 modifies the process speed in accordance with that type. In other words, the CPU 67 modifies the rotating speeds of the screws 58 and 59, and the circulation period of the developer also changes. As described above, because a long period ripple corresponds to the developer circulation period, when the circulation period is modified, the ripple period (frequency) also changes. Accordingly, if the CPU 67 adjusts the stopband of the bandstop filter 113 in accordance with the process speed and the type of the recording medium, it can control with higher precision replenishment of the developing unit with toner in an image forming apparatus having a plurality of process speeds.

Here, in general, the stopband of the bandstop filter 113 is adjustable by modifying the filter coefficients. However, if the bandstop filter 113 is realized by a digital filter, it is possible to modify the stopband even by modifying the calculation execution time interval of the filter calculation described above. For example, assume that the ripple period for the process speed for a normal paper is 30 seconds, and the calculation execution time interval for the process speed for normal paper is 0.1 seconds. When it is assumed that the ripple period for the process speed for thick paper is 60 seconds, if the calculation execution time interval for the process speed for thick paper is modified to 0.2 seconds, ripples can be reduced. Note that the calculation execution time interval is a temporal interval for execution of 1 calculation loop comprised of step S203 through step S213. This means that if the calculation execution time interval is 0.1 seconds, the calculation loop is executed one time every 0.1 seconds.

Figure 12:
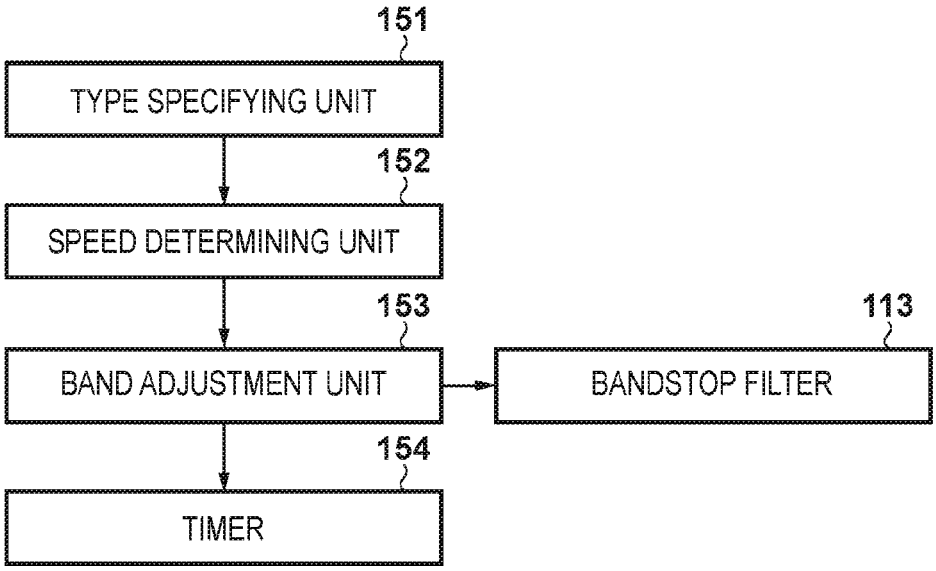
FIG. 12 is a block diagram for illustrating a function for adjusting a stopband in accordance with a process speed.

FIG. 12 is a block diagram for illustrating an example of functions added as functions that the CPU 67 executes. A type specifying unit 151 specifies a type of a recording medium based on information input from an operation unit, a host computer, a sensor or the like. As the sensor, for example, there is an optical sensor for detecting a grammage based on a transmitted light amount of a recording medium, an ultrasonic sensor for detecting a grammage based on an ultrasonic wave transparency amount, or the like. The type specifying unit 151 outputs information indicating the recording medium type to a speed determining unit 152. In other words, the type specifying unit 151 is an example of a type acquisition unit for acquiring information related to the type of the sheet on which the image is formed by the image forming apparatus. The drive unit drives the circulating unit based on information related to the type of the sheet acquired by the type acquisition unit. The drive unit adjusts the conveying speed at which toner is conveyed by the circulating unit based on information related to the type of the sheet. The speed determining unit 152 determines the process speed based on information indicating the type of the recording medium (examples: normal paper, thick paper, etc.), and outputs the process speed to a band adjustment unit 153. Also, the speed determining unit 152 determines the rotating speed of the screws 58 and 59 based on the process speed, and sets the developing controller 120. Note that the storage unit 68 may hold information such as a database or a table indicating a correspondence relationship with process speeds and information indicating types of the recording medium. Also, the storage unit 68 may hold a conversion function, a database, or a table or the like indicating a correspondence relationship between process speeds and rotating speeds of the screws 58 and 59. With this, the speed determining unit 152 may determine the rotating speed and the process speed with reference to the information stored in the storage unit 68. The band adjustment unit 153 adjusts the stopband of the bandstop filter 113 in accordance with the process speed. The band adjustment unit 153 adjusts the stopband to reduce a 30 second period ripple if, for example, the process speed is a first process speed V1. Also, the band adjustment unit 153 adjusts the stopband to reduce a 60 second period ripple if, for example, the process speed is a second process speed V2. The first process speed V1 is a process speed for a normal paper and the second process speed V2 is a process speed for a thick paper. Note that if the above described filter calculation is executed, the band adjustment unit 153 may adjust the stopband by setting the calculation execution time interval. The bandstop filter 113 operates in accordance with the stopband set by the band adjustment unit 153, and reduces a long period ripple. The storage unit 68 may store a conversion function, a database, or a table or the like indicating a correspondence relationship between process speeds and the stopband. The band adjustment unit 153 may also acquire the stopband with reference to information stored in the storage unit 68 based on the process speed. A timer 154 is a timer for managing the interval at which to execute the sequence of filter calculations from the sampling of the toner density to the replenishment amount calculation. By modifying the calculation execution time interval, the band adjustment unit 153 sets to the timer 154 a calculation execution time interval in accordance with the process speed in a case where the stopband is adjusted. The storage unit 68 may store a conversion function, a database, or a table or the like indicating a correspondence relationship between process speeds and calculation execution time intervals. The band adjustment unit 153 may also acquire the calculation execution time interval with reference to information stored in the storage unit 68 based on the process speed. Note that the band adjustment unit 153 may acquire a filter coefficient corresponding to the process speed from the storage unit 68 and set it to the bandstop filter 113.

Figure 13:
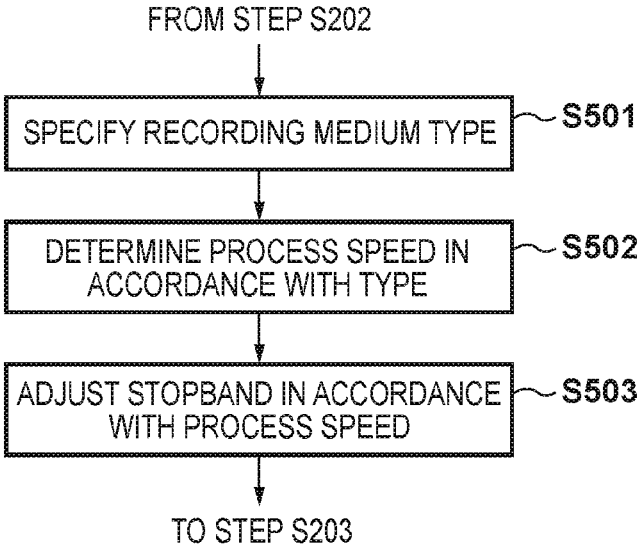
FIG. 13 is a flowchart for illustrating a method for adjusting a stopband in accordance with a process speed.

FIG. 13 is a flowchart illustrating steps added to the filter operation processing illustrated in FIG. 4. Step S501 through step S503 are added between step S202 and step S203 illustrated in FIG. 4. In step S501, the CPU 67 (the type specifying unit 151) specifies a type of a recording medium based on information input from an operation unit, a host computer, a sensor or the like. In step S502, the CPU (the speed determining unit 152) determines the process speed in accordance with the recording medium type. Note that the process speed is information relating to a circulation period at which the circulating unit causes toner to circulate. The speed determining unit 152 is an example of an acquisition unit for acquiring information related to the circulation period at which the circulating unit causes toner to circulate. The circulation period changes in accordance with the conveying speed at which toner is conveyed by the circulating unit. In step S503, the CPU 67 (the band adjustment unit 153) adjusts the stopband of the bandstop filter 113 in accordance with the process speed. In this way, the band adjustment unit 153 is an example of a determining unit for determining a correction condition <a filter coefficient> based on information acquired by the acquisition unit. Also, the band adjustment unit 153 is an example of a determining unit for determining a calculation condition <a calculation execution time interval> based on information acquired by the acquisition unit. For a method of adjusting the stopband, there is a method of adjusting a filter coefficient, and a method of adjusting a calculation execution time interval.

Figure 14:
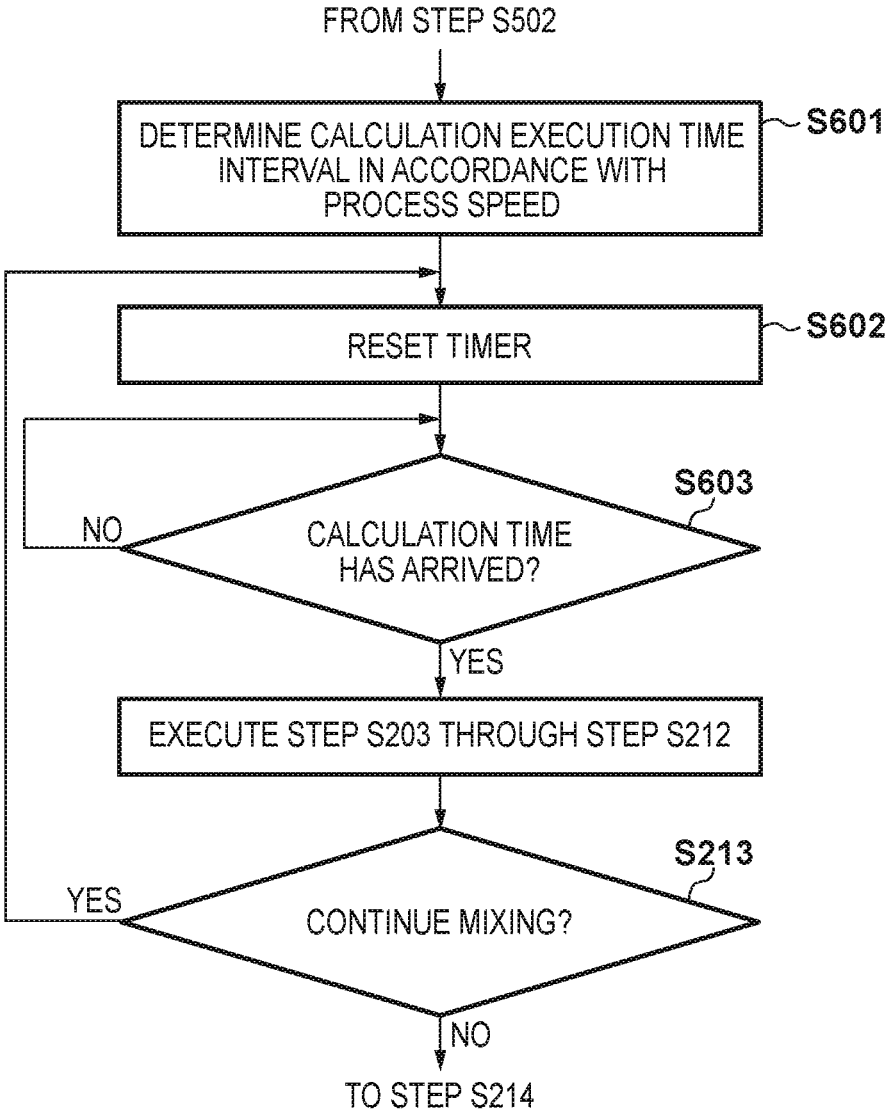
FIG. 14 is a flowchart for illustrating a method for adjusting a stopband in accordance with a process speed.

FIG. 14 is a flowchart illustrating steps added to the filter operation processing illustrated. Here, a step of adjusting the stopband in step S503 is comprised by step S601 through step S603. In step S601, the CPU 67 (the band adjustment unit 153) determines the calculation execution time interval in accordance with the process speed. In step S602, the CPU 67 resets the timer 154 to zero. In step S603, the CPU 67 determines whether or not the calculation time has arrived based on time measured by the timer 154 and the calculation execution time interval. The calculation time arrives periodically every calculation execution time interval. For example, if the calculation execution time interval is 0.2 seconds, the calculation time arrives every 0.2 seconds. When the calculation time arrives, the CPU 67 executes the above described step S203 through step S213. However, when it is determined that mixing should be continued in step S213, the CPU 67 returns to step S602, resets the timer 154, and waits for the next calculation time.

In this way, by adjusting the stopband of the bandstop filter 113 in accordance with the process speed, a long period ripple whose period changes in accordance with the process speed can be reduced. With this, even in an image forming apparatus with a plurality of process speeds, it is possible to control at a high precision replenishment of the developing unit with toner. Note that the bandstop filter 113 is an example of a correction unit for correcting a detection result of the detection unit based on a correction condition determined by the determining unit. Also, the replenishment driver 69 is an example of a controller for controlling the replenishment unit based on the detection result corrected by the correction unit. The bandstop filter 113 is an example of a calculation unit for calculating the amount of toner with which to replenish the developing unit from the output value outputted from the output unit based on the calculation condition determined by the determining unit. The replenishment driver 69 is an example of a controller for controlling the replenishment unit based on an amount calculated by the calculation unit.

Incidentally, the fixing unit, the photosensitive drum 40, the carry belt 47 and the conveyance roller arranged for a conveyance path rotate at a circumferential speed matching the process speed. As described above, the screws 58 and 59 rotate at a rotating speed proportional to the process speed. In other words, the motor 72 drives not just the screws 58 and 59 but also other rotating members. Also, other rotating members may be driven by other motors. In any case, the screws 58 and 59 rotate at a rotating speed proportional to the process speed. For this reason, the frequency of the long period ripple changes in accordance with the process speed.

CONCLUSION

In accordance with this embodiment, the replenishment controller 110 is provided with the bandstop filter 113 and the first determining unit 114. The bandstop filter 113 reduces a long period ripple that occurs in accordance with a toner circulation period in accordance with the screws 58 and 59 in the toner density detected by the density sensor 20. The first determining unit 114 determines the first replenishment amount R1n based on the toner density for which the long period ripple is reduced by the bandstop filter 113. With this, it becomes possible to control at a high precision the replenishment of the developing unit 44 with toner. In particular, when aiming for a reduction in capacity or a miniaturization of the developing unit 44, a long period ripple becomes noticeable. Accordingly, by reducing this long period ripple, replenishment of the developing unit 44 with toner is of a higher precision. In other words, a reduction in capacity and a miniaturization of the developing unit 44 and a precision improvement for replenishment are both achieved where it was difficult to achieve both up until now.

As is explained using FIG. 4, the bandstop filter 113 is configured so as to execute a filter calculation at predetermined intervals during operation of the screws 58 and 59, for example. As is explained regarding step S214, or the like, the replenishment controller 110 comprises the storage unit 68 for storing a calculation variable used by the bandstop filter 113 when the screws 58 and 59 are stopped. As explained regarding step S202, step S204 or the like, the bandstop filter 113 is configured to execute a filter calculation using the calculation variables Pn and Qn read from the storage unit 68 when the screws 58 and 59 start operation. With this, a ripple is reduced precisely by continuing to use the calculation variables Pn and Qn of the previous time.

The replenishment controller 110 may further comprise the averaging unit 121 which masks the toner density output from the density sensor 20 across a predetermined period from when the screws 58 and 59 start operation so that it is not reflected in the first replenishment amount R1n. The averaging unit 121 is an example of a calculation unit for averaging a detection result of the detection unit. Note that the correction unit corrects the calculation result of the calculation unit based on a correction condition (a filter coefficient) determined by the determining unit. Also, the calculation unit averages the output values outputted from the output unit, and calculates an amount from the average value of output values based on the calculation condition determined by the determining unit. As is explained regarding FIG. 7A or the like, even if the moving average D2 is obtained for the detected values D1 of the density sensor 20, the moving average D2 does not converge to an actual value in a predetermined period from when the screws 58 and 59 start operation. Accordingly, it becomes possible to further control replenishment of the developing unit 44 with toner at a higher precision by masking the moving average D2 for the detected values D1 for a predetermined period from when the screws 58 and 59 start operation.

Also, the averaging unit 121 may also function as a reduction unit for reducing a short period ripple that occurs in the toner density in accordance with a mixing period of the screws 58 and 59. As described above, the screws 58 and 59 are driven by a motor and rotate, conveying toner while mixing. Accordingly, a short period ripple occurs in accordance with the rotation period of the screws 58 and 59. Accordingly, by the averaging unit 121 reducing the short period ripple, it becomes possible to control at a high precision replenishment of the developing unit 44 with toner. Note that the calculation unit averages the output values outputted from the output unit, and calculates an amount of toner with which to replenish the developing unit from the average value of the output values based on a calculation condition determined by the determining unit.

Figure 8:
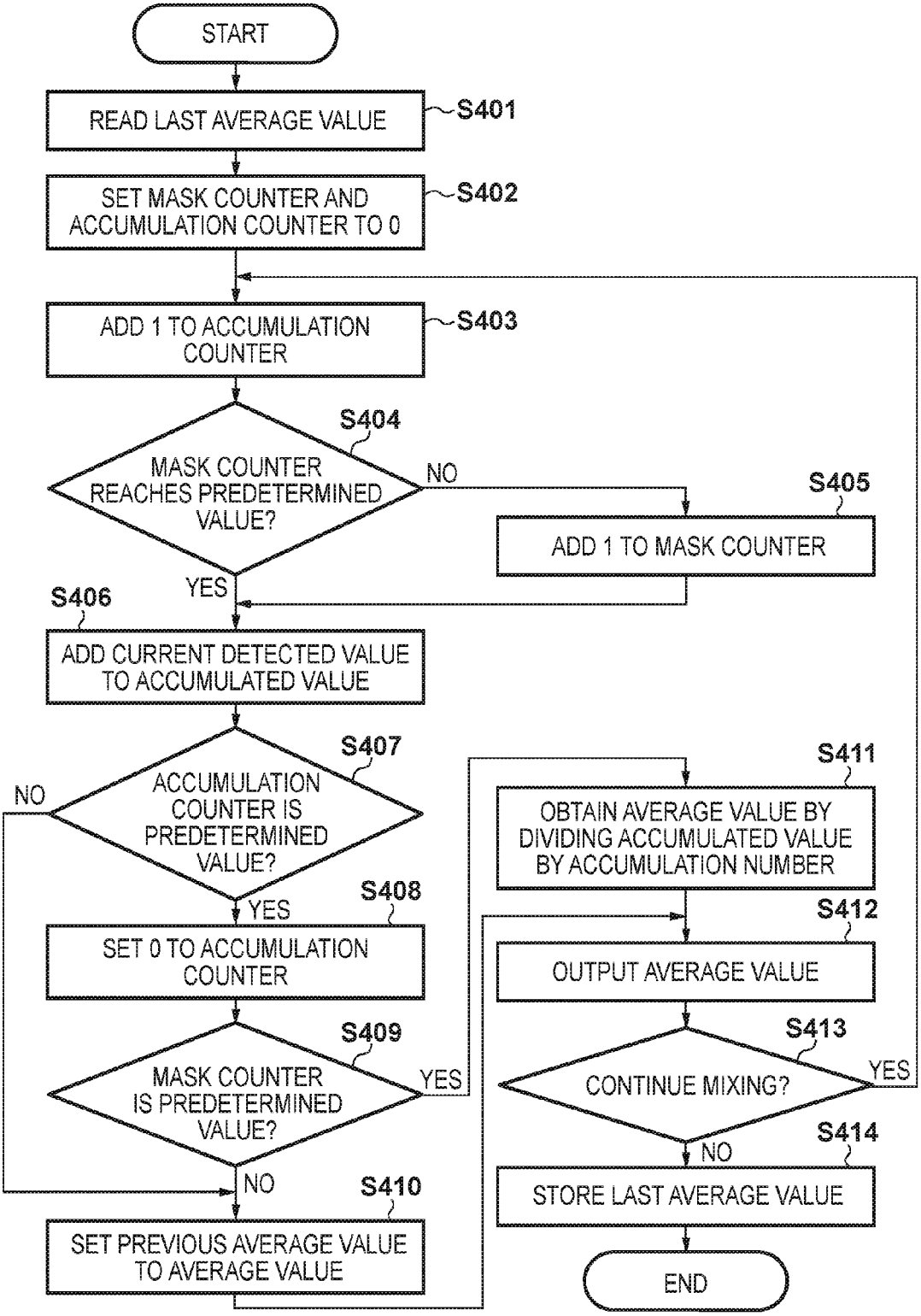
FIG. 8 is a flowchart for illustrating an example of averaging and mask processing.

As is explained regarding FIG. 8, the averaging unit 121 may also hold in the storage unit 68 a toner density (example: a detected value D1, the average value D3, or the like) for when the screws 58 and 59 are stopped. The averaging unit 121 may cause the toner density held in the storage unit 68 to be reflected in the first replenishment amount R1n in place of the masked toner density for the predetermined period when the screws 58 and 59 resume operation. In the bandstop filter 113, data for the toner density becomes necessary immediately when the screws 58 and 59 resume operation. However, the toner density is not provided in the masking interval. Accordingly, the storage unit 68 stores the toner density when the screws 58 and 59 are stopped, and the averaging unit 121 reads that out and uses it when the rotation of the screws 58 and 59 resumes. With this, when the screws 58 and 59 resume operation, the toner density (average value) is supplied to the bandstop filter 113 immediately. Because the toner 63 is not replenished while the screws 58 and 59 are stopped, the toner density of the developing material 43 does not change. Accordingly, even if the toner density for when replenishing the previous time is used as the toner density for when replenishing this time, a replenishment amount calculation precision is not degraded much.

The averaging unit 121 may also function as an averaging unit for obtaining an average value of the toner densities that the density sensor 20 outputs. In such a case, the replenishment controller 110 controls the replenishment amount using the average value of the toner densities. The averaging unit 121 may obtain a moving average value of toner densities that the density sensor 20 outputs. Because not so many detected values of toner density are required to obtain the moving average value, the storage capacity for holding the detected values of toner density is reduced. Additionally, the sample number used in calculating the moving average value (the number of detected values of toner density) is set to a number of an extent to which the short period ripple can be reduced.

As is explained using FIG. 3, the difference unit 111 may calculate the difference Xn between the toner density (average value) and a target density. In such a case, the bandstop filter 113 reduces the frequency component of a ripple in the frequency components included in the difference by applying a filter calculation to the difference Xn for toner density. Such a frequency passage characteristic of the bandstop filter 113 is a frequency passage characteristic for which the frequency component of the ripple is reduced as is illustrated in FIG. 5A. In this way, a coefficient necessary for the filter calculation is determined depending on the frequency of the ripple.

As is explained using FIG. 3, by determining the replenishment amount considering not only the toner density but also the toner consumption amount obtained from the image signal, the toner replenishment amount is controlled stably. In such a case, the counter 66 counts the toner amount consumed in developing an electrostatic latent image based on the image signal. The second determining unit 116 determines the second replenishment amount R2n based on the count value of the counter 66. The totaling unit 117 totals the first replenishment amount R1n that the first determining unit 114 determines and the second replenishment amount R2n that the second determining unit 116 determines. The CPU 67, the developing controller 120, and the toner replenishment basin 60 replenish the developing unit 44 with toner based on the total value of the totaling unit 117. With this, the toner replenishment amount is controlled stably. Note that, the second determining unit 116 may determine the second replenishment amount R2n by plurally dividing the replenishment amount obtained by converting the count value. The toner consumption amount for 1 image is not ascertained until the count ends. When the toner consumption amount is reflected in the replenishment amount all at once, the replenishment amount is not stable as explained using FIG. 11C and FIG.

11D. This leads to an increase in ripples. Accordingly, by distributing the toner consumption amount for 1 image temporally, and causing it to be reflected in the replenishment amount, the replenishment amount is stable, as is explained using FIG. 11A, FIG. 11B or the like. In other words, a ripple in the toner density is reduced.

There are cases in which a ripple occurs in the developing unit 44, which is divided into the developing chamber and the mixing chamber. Accordingly, by applying the present embodiment, it becomes possible to control at a high precision replenishment of the developing unit 44 with toner.

As is explained using FIG. 12 through FIG. 14, the bandstop filter 113, the band adjustment unit 153, or the like adjust a stopband of a long period ripple in accordance with the modified circulation period when the circulation period of the developer is modified. In this way, by adjusting the stopband of the bandstop filter 113 in accordance with the circulation period, a long period ripple whose period changes in accordance with the circulation period is reduced. As described above, because the circulation period and the process speed are correlated, adjusting the stopband in accordance with the process speed is equivalent to adjusting a stopband in accordance with the parameters correlated with the process speed such as the conveying speed, the circulation period, or the like. With this, even in an image forming apparatus with a plurality of process speeds, it is possible to control at a high precision the replenishment of the developing unit with toner.

When the process speed is modified, the rotating speed of the conveyance rollers arranged for a conveyance path, the rotating speed of the photosensitive drum 40, and the rotating speed of a pressure roller of the fixing unit are modified. In other words, the circulation period of developer is linked to the conveying speed of the conveyance rollers arranged for a conveyance path. Similarly, the circulation period of developer is linked to the rotating speed of the photosensitive drum 40. Similarly, the circulation period of developer is linked to the rotating speed of the pressure roller. Because the long period ripple period (frequency) changes when the circulation period is modified, it is necessary that the stopband of the bandstop filter 113 be adjusted. In the present embodiment, by adjusting the stopband of the bandstop filter 113 the process speed is modified, a long period ripple whose period changes in accordance with the process speed is reduced precisely.

The bandstop filter 113, the band adjustment unit 153, or the like, modify an execution time interval for the filter calculation for the bandstop filter 113 in accordance with the circulation period when the circulation period is modified. In this way, because the circulation period is correlated with the process speed, as is explained using FIG. 14, the stopband of the bandstop filter 113 is adjusted by the execution time interval of the filter calculation being adjusted in accordance with the circulation period. In other words, the bandstop filter 113 reduces the long period ripple having a frequency component in accordance with the circulation period.

The conveying speed of the recording medium (the process speed) may be selected from among a first conveying speed and a second conveying speed that is slower than the first conveying speed in accordance with the type of the recording medium. For example, the first conveying speed is a process speed V1 for normal paper and the second conveying speed is a process speed V2 for thick paper. The bandstop filter 113 may execute a filter calculation using a first filter coefficient determined in advance to reduce a ripple of a frequency component in accordance with the circulation period corresponding to the first conveying speed when the first conveying speed is selected for the carry belt 47. Also, the bandstop filter 113 may execute a filter calculation using a second filter coefficient determined in advance to reduce a ripple of a frequency component in accordance with the circulation period corresponding to the second conveying speed when the second conveying speed is selected for the carry belt 47. In this way, the stopband of the bandstop filter 113 is adjustable by modifying a filter coefficient without modifying the calculation execution time interval. Also, the stopband of the bandstop filter 113 is adjustable by modifying a filter coefficient without modifying the calculation execution time interval.

Because the long period ripple is correlated with the circulation period of the developer, explanation was given for the band adjustment unit 153 adjusting the stopband of the bandstop filter 113 in accordance with the circulation period. As described above, the process speed (the conveying speed of the recording medium) or the like is a parameter that is correlated to the circulation period. Accordingly, the band adjustment unit 153 adjusts the stopband of the bandstop filter 113 in accordance with the process speed. Also, there is a correlation between the process speed and the type of the recording medium. Accordingly, the band adjustment unit 153 may adjust the stopband in accordance with the type of the recording medium. In any case, the stopband is adjusted as appropriate in accordance with frequency and period of the ripple.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-002596, filed Jan. 8, 2015, which is hereby incorporated by reference herein in its entirety.

What is claimed is:

1. An image forming apparatus, comprising:

a photosensitive member;

a latent image forming unit configured to form an electrostatic latent image on the photosensitive member;

a developing unit including a container in which a toner is stored, and configured to develop the electrostatic latent image using the toner in the container;

a circulating unit configured to convey the toner in a predetermined direction in order to cause the toner to circulate in the container;

a drive unit configured to drive the circulating unit;

a replenishment unit configured to replenish the developing unit with toner;

a detection unit configured to detect a density of the toner in the container;

an acquisition unit configured to acquire information related to a circulation period at which the circulating unit causes the toner to circulate;

a determining unit configured to determine a correction condition based on the information acquired by the acquisition unit;

a correction unit configured to correct a detection result of the detection unit based on the correction condition determined by the determining unit; and a controller configured to control the replenishment unit based on the detection result corrected by the correction unit.

2. The image forming apparatus according to claim 1, wherein the circulation period changes in accordance with a conveying speed at which the toner is conveyed by the circulating unit, and the information corresponds to the conveying speed.

3. The image forming apparatus according to claim 1, wherein the circulating unit comprises a screw that is rotationally driven by the drive unit, the correction unit further comprises a calculation unit for averaging detection results of the detection unit, and the correction unit corrects a calculation result of the calculation unit based on the correction condition determined by the determining unit.

4. The image forming apparatus according to claim 1, wherein the correction condition corresponds to a filter coefficient, and the correction unit applies a detection result of the detection unit to a filter based on the filter coefficient determined by the determining unit.

5. The image forming apparatus according to claim 1, wherein the photosensitive member is rotationally driven, the drive unit drives the circulating unit so that the circulation period changes in accordance with a rotating speed of the photosensitive member, and the information corresponds to the rotating speed of the photosensitive member.

6. The image forming apparatus according to claim 1, further comprising a type acquisition unit configured to acquire information related to a type of a sheet on which the image forming apparatus forms an image, wherein the drive unit drives the circulating unit based on the information related to the type of the sheet acquired by the type acquisition unit, wherein the drive unit adjusts a conveying speed at which the toner is conveyed by the circulating unit based on the information related to the type of the sheet, and wherein the information corresponds to the information related to the type of the sheet.

7. The image forming apparatus according to claim 1, wherein the controller prohibits the replenishment unit from replenishing the developing unit with toner if a predetermined amount of time has not elapsed since a previous time that replenishment was executed by the replenishment unit.

8. The image forming apparatus according to claim 1, further comprising a prediction unit configured to predict an amount of toner that was consumed from the developing unit based on inputted image data, wherein the controller controls the replenishment unit based on a prediction result of the prediction unit and the detection result corrected by the correction unit.

9. An image forming apparatus, comprising:

a photosensitive member;

a latent image forming unit configured to form an electrostatic latent image on the photosensitive member;

a developing unit including a container in which a toner is stored, and configured to develop the electrostatic latent image using the toner in the container;

a circulating unit configured to convey the toner in a predetermined direction in order to cause the toner to circulate in the container;

a drive unit configured to drive the circulating unit;

a replenishment unit configured to replenish the developing unit with toner;

an output unit configured to output an output value that changes in accordance with a density of the toner in the container;

an acquisition unit configured to acquire information related to a circulation period at which the circulating unit causes the toner to circulate;

a determining unit configured to determine a calculation condition based on the information acquired by the acquisition unit;

a calculation unit configured to calculate an amount of toner with which to replenish the developing unit from the output value outputted from the output unit based on the calculation condition determined by the determining unit; and a controller configured to control the replenishment unit based on the amount calculated by the calculation unit.

10. The image forming apparatus according to claim 9, wherein the circulation period changes in accordance with a conveying speed at which the toner is conveyed by the circulating unit, and the information corresponds to the conveying speed.

11. The image forming apparatus according to claim 9, wherein the circulating unit comprises a screw that is rotationally driven by the drive unit, and the calculation unit averages the output values outputted from the output unit, and calculates an amount from an average value of the output values based on the calculation condition determined by the determining unit.

12. The image forming apparatus according to claim 9, wherein the photosensitive member is rotationally driven, the drive unit drives the circulating unit so that the circulation period changes in accordance with a rotating speed of the photosensitive member, and the information corresponds to the rotating speed of the photosensitive member.

13. The image forming apparatus according to claim 9, further comprising a type acquisition unit configured to acquire information related to a type of a sheet on which the image forming apparatus forms an image, wherein the drive unit drives the circulating unit based on the information related to the type of the sheet acquired by the type acquisition unit, wherein the drive unit adjusts a conveying speed at which the toner is conveyed by the circulating unit based on the information related to the type of the sheet, and wherein the information corresponds to the information related to the type of the sheet.

14. The image forming apparatus according to claim 9, wherein the controller prohibits the replenishment unit from replenishing the developing unit with toner if a predetermined amount of time has not elapsed since a previous time that replenishment was executed by the replenishment unit.

15. The image forming apparatus according to claim 9, further comprising a prediction unit configured to predict an amount of toner that was consumed from the developing unit based on inputted image data, wherein the controller controls the replenishment unit based on the amount predicted by the prediction unit and the amount calculated by the calculation unit.

* * * * *